US007815275B2

(12) United States Patent
Guo et al.

(10) Patent No.: US 7,815,275 B2
(45) Date of Patent: Oct. 19, 2010

(54) INTERACTIVE VISUAL CARD-SELECTION PROCESS FOR MITIGATING LIGHT-AREA BANDING IN A PAGEWIDE ARRAY

(76) Inventors: Shilin Guo, 16399 W. Bernardo Dr., San Diego, CA (US) 92127-1899; Guo Li, 9464 Chesapeake Dr. Suite710 c/o UPS Logistics, San Diego, CA (US) 92123; Rob Patrick Chohan, 16399 W. Bernardo Dr., San Diego, CA (US) 92127-1899; Julie Huynh, 16762 Saintsbury Glen, San Diego, CA (US) 97127

( * ) Notice: Subject to any disclaimer, the term of this patent is extended or adjusted under 35 U.S.C. 154(b) by 752 days.

(21) Appl. No.: 11/881,553

(22) Filed: Jul. 27, 2007

(65) Prior Publication Data

US 2009/0028585 A1 Jan. 29, 2009

(51) Int. Cl.
*B41J 29/38* (2006.01)
*B41J 29/393* (2006.01)

(52) U.S. Cl. ..... 347/13

(58) Field of Classification Search ..... 347/19, 347/13

See application file for complete search history.

(56) References Cited

U.S. PATENT DOCUMENTS 6,089,693 A 7/2000 Drake et al.
6,199,969 B1 3/2001 Haflinger et al.
6,238,112 B1 5/2001 Girones et al.
6,890,760 B1 5/2005 Webb
2002/0145743 A1 10/2002 Lopez et al.
2004/0046811 A1 3/2004 D'Souza et al.
2005/0052494 A1* 3/2005 Takahashi et al. ..... 347/41

FOREIGN PATENT DOCUMENTS

EP 1 650 032 4/2006
WO WO 2006/081051 8/2006

OTHER PUBLICATIONS

Yifeng Wu, Fast Printer Color Calibration Using Pre-Build Linearization Tables, SPIE USE, . 2 5667-46 (p. 1-8), Date: Oct. 22, 2004.

* cited by examiner

*Primary Examiner*—Uyen-Chau N Le
*Assistant Examiner*—Kajli Prince

(57) ABSTRACT

Preferably, test-patterns print on separate, multiple print-medium cards, each including a ramp with colors graded along a certain direction—and, superimposed on the ramp, a candidate add-on colorant. Ramps preferably are printed in so-called "customer colors", common in snapshots and particularly snapshot regions that include sky. Positions or amounts of the candidate add-on colorant canvass a likely range of values that optimize camouflaging or suppression of a banding artifact (due to seams in the pagewide array) that is extended along the same certain direction. For each seam and each "customer color" used, an operator holds up several cards for comparison, selecting the best one to three. Operators thus can evaluate candidate colorant patterns in context of many different tones of the sky and other customer colors. Preferably banding suppression is integrated with linearization: at each seam a series of linearization tables is smoothly interpolated between measurement-based tables for adjacent inkjet dice.

18 Claims, 8 Drawing Sheets

INTERACTIVE VISUAL CARD-SELECTION PROCESS FOR MITIGATING LIGHT-AREA BANDING IN A PAGEWIDE ARRAY

FIELD OF THE INVENTION

This invention relates generally to incremental printing with a pagewide array, especially an array that is constructed from plural individual printing elements; and more particularly to correction or reduction of color-banding errors made by such an array at seams between adjacent such elements. Most such pagewide arrays of interest for purposes of this document are inkjet devices; thus each printing element in such a device is an inkjet "die" (plural, in this document, "dice").

Also for purposes of this document, "incremental" printing means printing that is performed a little at a time (e.g. one line at a time), substantially under direct real-time control of a computer (a dedicated computer or a separate general-purpose computer—or combinations of these). Incremental printing thus departs from more-traditional lithographic or letterpress printing, which creates substantially a full-sheet image with each rotation or impression of a press.

Although xerographic printing (most commonly laser based) is generally considered incremental, most such printing uses unitary means for effecting image transfer to printing media—and therefore lacks "seams" such as mentioned above. Hence in general this incremental-printing invention is in a different field from xerography.

BACKGROUND OF THE INVENTION

Commercially popular, successful incremental printing systems primarily encompass inkjet and dry electrographic—i.e. xerographic—machines. (As noted above, the latter units are only partially incremental.) Inkjet systems in turn focus mainly upon on-demand thermal technology, as well as piezo-driven and variant hot-wax systems.

On-demand thermal inkjet, and other inkjet, techniques have enjoyed a major price advantage over the dry systems—and also a very significant advantage in electrical power consumption (largely due to the energy required to fuse the dry so-called "toner" powder into the printing medium). These advantages obtain primarily in the market for low-volume printing, and for printing of relatively short documents, and for documents that include color images or graphics.

A "dedicated computer" such as mentioned above may take any of a great variety of forms, including one or more application-specific integrated circuits ("ASICs"). Another option, merely by way of example, is one or more partially or completely preprogrammed patch boards such as raster image processors ("RIPs").

Pagewide arrays have been commercialized for years. In the past, however, such arrays have been somewhat disfavored because—in comparison with scanning printers—as a practical matter they offer relatively little opportunity to mitigate end-effects of individual dice through multipass printing.

To look at this from a somewhat opposite perspective, multipass printing is itself undesirable because it is time consuming; and one especially important appeal of pagewide arrays is printing speed or so-called "through-put". Speed of printing, together with cost, is a major driver of competition in the incremental-printing field.

Hence, minimizing the number of printing passes in a pagewide system is extremely important; however, adverse image-quality effects that arise at and near the end of each individual inkjet die in a pagewide array are also extremely important. These adverse effects tend to under-cut the principal advantages and the strong commercial appeal of pagewide printing.

As always, a critical challenge in pagewide printing machines is this tension between design to minimize the number of passes and design to maintain excellent image quality. The present invention answers this challenge by following a different path to high image quality.

More specifically, one obstacle to best quality in a pagewide machine is that a large number of variables affects quality at each point in an image:

First, inkjet dice are not uniform—neither along the length of each die, nor as among the plural dice that make up a single pagewide array. Therefore different imaging properties arise conspicuously in high-volume use of any pagewide array. Due to these nonuniformities, as will be detailed and explained in a later section of this document, typical pagewide arrays are found to print so-called "light-color bands" (in this document used interchangeably with "light-area bands") along the direction of motion of the printing medium, beneath the arrays.

Second, color printing is expected to perform properly over a very great range of tonal values in the images to be printed for end-customers or other end-users. That is to say, the tonal operating range is not subject to selection by the designer or the printer—or by the printer operator, either. Therefore the light-color banding cannot be avoided by choosing tonal operating range.

Third, from the viewpoint of a system designer, the images themselves likewise must be considered arbitrary, also not subject to selection. In other words, both the designer and the machine operator must take every image that appears in the print queue as they find it. Most particularly, the positional distribution of tonal values within every image is not under control of the designer, the operator or the machine itself in the field. Therefore the light bands also cannot be removed by shifting the image relative to the printing system.

Fourth, as a consequence the positional distribution of tones is likewise not controllable in relation to the individual dice—or, most particularly, in relation to either (1) position alone each die, or (2) specific micro-location of internal portions of the die ends. Once again the machine is expected to somehow do the best possible job of rendering every tone value that arrives for printing, regardless of interactions with the other factors stated above.

This best-possible rendering is required, or at least very importantly desired, even though detailed image features may (and probably will) require different treatment depending on the part of the image which contains that tone value and those image features. The implication of this requirement, therefore, is that the original machine design should somehow accommodate the unknown, unknowable relationships among the tone, the feature, and most specifically their positions between or within the die ends.

Fifth, preferably all this optimization should avoid the high costs and computation times inherent in previous solutions that required, e.g., high-resolution scanners built into the printing machine or separately deployed. Such equipment also must be interfaced with the computing apparatus that controls the printer, and in general this precludes or at least discourages use of third-party scanners whose operating parameters are potentially and in fact usually alien to the computer system. This is an unfortunate requirement, since such third-party scanners are often available on the open market and often (being necessarily competitive) very economical.

Sixth, and perhaps even more troublesome than other factors discussed above, we have found that even when a high-resolution scanner is used to guide the band-hiding operation of the printer, optimization is less than ideal. That is, resultant band-hiding as then perceived by human users is not very good—or not as good as desired. Perceptual mismatch diverges significantly from straightforward machine-based tonal analysis. The divergence can be attributed to nonlinearities in both the perceptual and machine domains; however, perhaps the former are larger.

Seventh, although various former procedures are known for controlling incremental printers in response to human input, those former methods fail to provide a satisfactory optimization for light-color banding in pagewide arrays. Specifically, past procedures used in operator/machine dialogs relate to simpler adjustments that involved fewer variables.

For instance these earlier methods are for aligning printheads to one another, or for matching inking levels. Therefore those methods first print a set of test patterns side by side, representing e.g. various candidate print-head-alignment relationships, or plural candidate color-matching relationships. An operator selects a candidate that forces two lines of different colors into alignment; or one that makes two colors appear to match in some simple regard, usually one-dimensional—e.g. intensity or saturation.

As suggested above by the first four discussions of printing variables, the problem addressed by this present invention is more complicated. There is no single variable domain in which a match-up can be made to resolve the multidimensional determination in this environment.

Yet another consideration is that inkjet printing, in general, benefits from linearization (at least moderately accurate linearization) of the relationship between tonal values specified in the input image data and human-perceived tonal values in the printed output image. Extremely precise linearization is not a requirement; yet some photographers—even some amateurs—are sensitive to nonuniform reproduction of tonal increments, and to other contrast anomalies. Some prior efforts to correct die-generated artifacts may simply overlay corrective colorant patterns onto already-linearized image regions, thus potentially generating a new and different kind of colorant error.

Conclusion—In summary, achievement of uniformly excellent inkjet printing, particularly using pagewide arrays, continues to be impeded by the above-mentioned problems of light-area, light-color bands appearing at or near seams between adjacent printing dice—due to printing nonuniformities at the seams. As shown above, these variations are aggravated by a very great range of tonal values to be printed, and the fact that such tones are free to occur at essentially any position in an image—and any position relative to the seams.

Other adverse factors include the cost of adequate scanning equipment, poor perceptual results even when good scanners are used, and too many variables for the simple match-ups used in prior perception-based methods—as well as failure to integrate corrections into the overall linearization scheme of the inkjet printing process. Another adverse effect may be imprecision of printing-medium advance in the transverse direction, between printing passes. Thus very important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is a method for improving image quality printed by a pagewide printing array. The array is made of several inkjet dice positioned generally end-to-end at array seams. The method steps, described below, are all performed for each seam.

The method includes the step of using the pagewide array to print multiple test-pattern cards having respective multiple candidate image-quality correction patterns. Another step is a human operator's holding up each card in turn for inspection by the operator, and setting aside cards that appear relatively poor in quality until only one to three cards remain not set aside.

An additional step is identifying the cards not set aside, by the operator's manually entering identities of those cards into a program dialog. Yet another step is automatically controlling the pagewide array, in subsequent printing of images, to select and use image-quality correction patterns corresponding to the identified cards for that seam.

The foregoing may represent a description or definition of the first aspect or facet of the invention in its broadest or most general form. Even as couched in these broad terms, however, it can be seen that this facet of the invention importantly advances the art.

In particular, by generating and evaluating a separate test-card for each candidate correction pattern, at each seam, the method opens the door to very sophisticated and subtle multidimensional comparisons that draw upon innate complex pattern-recognition capabilities of humans. In particular such comparisons are very greatly facilitated by the ability to make groupings or subgroupings of the test-cards, and to look at the cards either singly or grouped side-by-side for direct comparison as preferred.

These capabilities in turn lead directly to more rapid, easier, and more accurate judgments as to settings that will produce best suppression of light-area banding. Other sections of this document provide additional detailed discussion of an operator's options for exploiting the benefits of the using and holding-up steps.

Although the first major aspect of the invention thus significantly advances the art, nevertheless to optimize enjoyment of its benefits preferably the invention is practiced in conjunction with certain additional features or characteristics. In particular, preferably the using, holding up, and identifying steps in combination—in at least one part of the inventive method—characterize the effective position of each seam; and the controlling step comprises controlling the array in accordance with the characterized position of each seam.

If this basic preference is observed, then preferably the using step includes printing, on each card, candidate correction patterns based upon respective different assumed effective seam positions. Another like subpreference is that the using, holding and identifying steps in combination also characterize ideal colorant profiles for each of at least one colorant; here the controlling step comprises controlling the array in accordance with the characterized ideal colorant profile.

If this last-mentioned subpreference is observed, then we further prefer that the using step comprise printing, on each card, candidate correction patterns based upon respective different assumed colorant-profile errors. Moreover if this latter condition is met too, then preferably the using step further comprises the step of superimposing the candidate correction patterns on a color ramp representative of colors that are susceptible to image-quality deterioration particularly at the array seams.

Another basic preference is that the method further include the step of operating the program dialog to receive the operator's manually entered identities. Still another basic preference is that the using include:

first, printing candidate correction patterns that canvass, to enable selection from among, both (1) likely effective seam locations, and (2) various different inking asymmetries or symmetry across each of those effective seam locations; and then, printing candidate correction patterns that canvass likely colorant intensities and distributions, at a selected seam location and inking asymmetry or symmetry.

In preferred embodiments of its second major independent facet or aspect, the invention is in combination, (1) a control system for a pagewide array made of inkjet dice positioned generally end-to-end at array seams; and (2) a set of test-pattern cards for improving image quality printed by the array. For each seam, the card set includes multiple candidate image-quality correction patterns. These are printed on multiple cards, respectively; and the control system is able to:

print the card set expressly for interactive use, by a human operator in holding up each card for inspection by the operator, and in setting aside cards that appear relatively poor in quality until only one to three cards remain not set aside, and cooperatively interact with the human operator in a program dialog, to receive the operator's manually entered identities of cards not set aside, and for each seam, automatically control the array, in subsequent printing of images, to select and use image-quality correction patterns corresponding to the identified cards.

The foregoing may represent a description or definition of the second aspect or facet of the invention in its broadest or most general form. Even as couched in these broad terms, however, it can be seen that this facet of the invention importantly advances the art.

In particular, this aspect of the invention provides efficient tools that enable an operator to actually perform—in a very short time—accurate comparisons within a very complex interplay of multidimensional factors that all bear on light-area banding. In addition the combination of control system and specialized test-cards establishes a collaboration, between the operator and the machine, that has generally the same advantages described above for the first main aspect of the invention.

Although the second major aspect of the invention thus significantly advances the art, nevertheless to optimize enjoyment of its benefits preferably the invention is practiced in conjunction with certain additional features or characteristics. In particular, preferably each correction pattern is superimposed on a color ramp representative of colors that are susceptible to image-quality deterioration particularly at the array seams.

If this basic preference is observed, then a subpreference is that some correction patterns be used to determine effective positions of array seams. In this case, a further subsubpreference is that the representative color ramp for use with the position-determining patterns includes these features:

along a light-blue edge, a combination of red, green and blue, substantially in intensities 135, 170 and 185 respectively;

along a dark-blue edge, a combination of red, green and blue, substantially in intensities 86, 123 and 164 respectively; and a gradation of colors between the two edges.

Each of the above-stated intensity values is with reference to an intensity scale from zero to 255.

An alternative subpreference, if the basic superposition preference is observed, is that some correction patterns be used to determine best color details of image-quality correction patterns. In this case there are three options:

A first such option is that the color-detail-determining correction patterns include (still with reference to an intensity scale from zero to 255):

along a light-magenta edge, a combination of red, green and blue, substantially in intensities 255, 219 and 255 respectively;

along a darker-magenta edge, a combination of red, green and blue, substantially in intensities 255, 101 and 255 respectively; and a gradation of colors between the two edges.

A second such option is that the color-detail-determining correction patterns include:

along a light-gray edge, a combination of red, green and blue, substantially in intensities 200, 200 and 200 respectively;

along a darker-gray edge, a combination of red, green and blue, substantially in intensities 100, 100 and 100 respectively; and a gradation of colors between the two edges.

The third such option is that the color-detail-determining correction patterns include:

along a gray edge, a combination of red, green and blue, substantially in intensities 110, 110 and 110 respectively;

along a substantially black edge a combination of the same three colors, each substantially at zero intensity; and a gradation of colors between the two edges.

Yet another basic preference is that the combination also include the pagewide array, the control system, and a printer incorporating the array and control system. If it does, then preferably the control system further includes means for: generating a series of linearization curves for multiple sub-boundaries within the seam, and means for applying the linearization curves to determine colorant levels at the sub-boundaries.

The linearization curves are smoothly interpolated between measured linearization curves for two adjacent dice. Each of these features is provided at each seam, and is based upon the cooperatively-interacting step.

In preferred embodiments of its third major independent facet or aspect, the invention is a method for training an operator of a printer. The printer includes an inkjet pagewide array which is made of several inkjet dice positioned generally end-to-end at array seams, and which is susceptible to light-area banding at the seams.

The method includes the step of instructing the operator to start a printer-calibration utility program that uses the array to print multiple test-pattern cards having, for each seam, respective multiple candidate image-quality correction patterns. Another step is instructing the operator to, for each seam, hold up each card in turn for inspection by the operator, and to set aside cards that appear relatively poor in quality until only one to three cards remain not set aside.

Yet another step is instructing the operator to, for each seam, identify the cards not set aside, by manually entering identities of those cards into a dialog of the utility program. The foregoing may represent a description or definition of the third aspect or facet of the invention in its broadest or most general form.

Even as couched in these broad terms, however, it can be seen that this facet of the invention importantly advances the art. In particular, this method specifically addresses the desirability of specialized training—for each operator of the method or the articles that are related to the first two aspects of the invention, as described above. In this way this third aspect of the invention promotes the benefits of those first aspects.

Although the third major aspect of the invention thus significantly advances the art, nevertheless to optimize enjoyment of its benefits preferably the invention is practiced in conjunction with certain additional features or characteristics. In particular, preferably the utility program causes the array to print the correction patterns.

The patterns are superimposed upon a color ramp that includes a color gradation at roughly right angles to the direction of each seam. The card-holding-up instructing step includes instructing the operator to consider, for each seam, overall image quality along substantially the entire length of the color ramp.

In preferred embodiments of its fourth major independent facet or aspect, the invention is a method for improving image quality printed by a pagewide printing array that is made of several inkjet dice positioned generally end-to-end at array seams. The method includes the step of, at each seam, determining a series of linearization curves for multiple subboundaries, respectively, within the seam.

The linearization curves are smoothly interpolated between measured linearization curves for two adjacent dice. The method also includes the step of applying the linearization curves to determine colorant levels to print at said subboundaries.

The foregoing may represent a description or definition of the fourth aspect or facet of the invention in its broadest or most general form. Even as couched in these broad terms, however, it can be seen that this facet of the invention importantly advances the art.

In particular, this method causes the overall image to behave as a consistent whole, in terms of both linearization and banding suppression—integrated together. As a result the likelihood is quite small that a conspicuous linearization artifact will arise from correction of banding. The converse is also true, i.e. there is little likelihood that banding will occur as a result of a linearization adjustment. At the same the quality of banding mitigation and the smoothness of blending and merging the banding corrections across the entire width of each boundary is quite good.

Although, the fourth major aspect of the invention thus moves the art forward significantly, nevertheless to optimize enjoyment of its benefits preferably the invention is practiced in conjunction with certain additional features or characteristics. In particular, preferably the other main aspects of the invention, and the preferences described above for those main aspects, are practiced in conjunction with this fourth facet of the invention.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

1. Introduction and Overview

Figure 1:
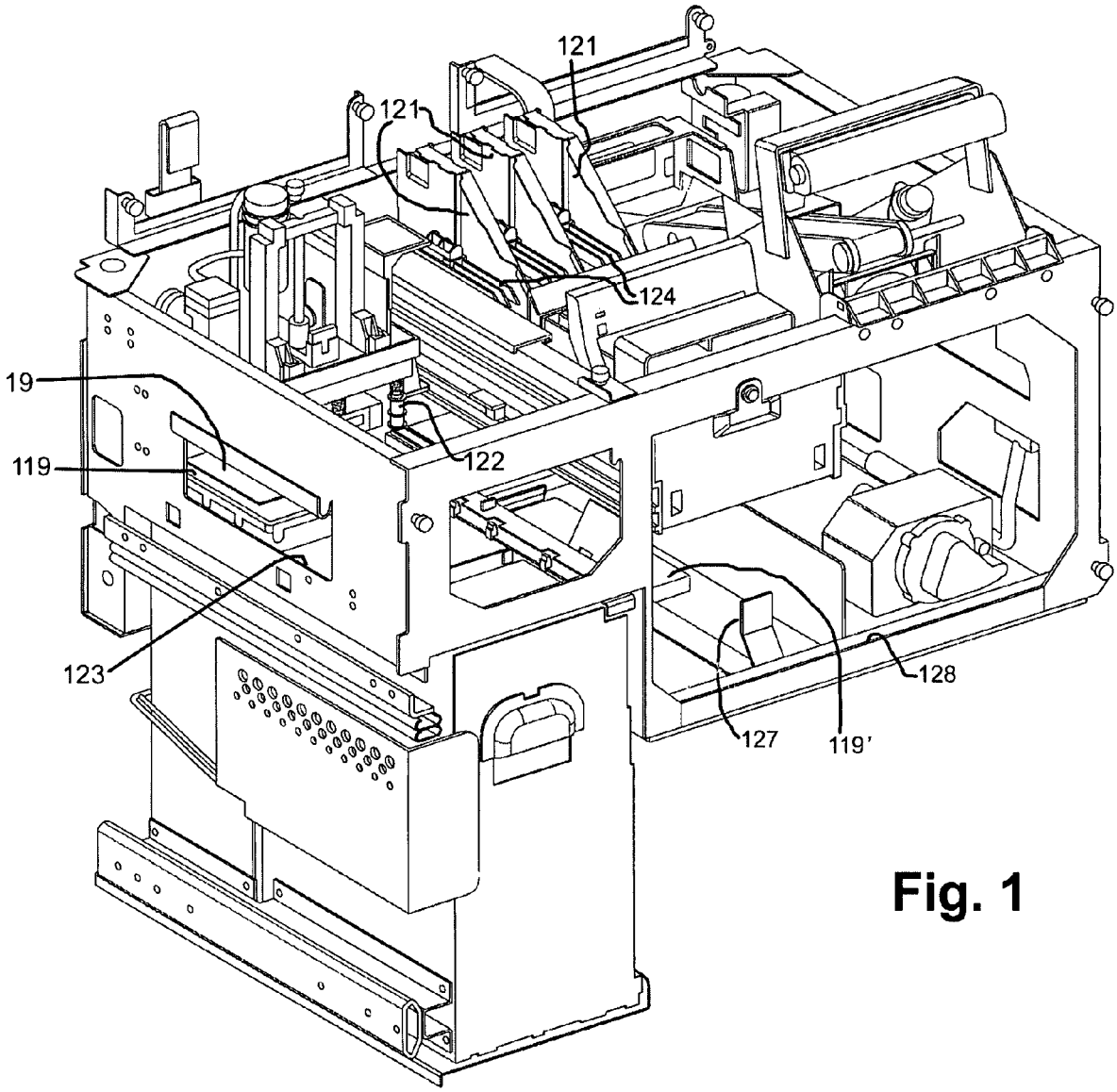
FIG. 1 is a perspective or isometric view, taken from above and to the left (as viewed by a user) of a printer that encompasses preferred embodiments of the present invention including three pagewide dual-color printing arrays, much of the apparatus outer case being shown removed for visibility of the interior.

Preferred embodiments of our invention are commonly used to improve image quality of printers in a retail service facility known as a "photo kiosk". This environment calls for high volume, high throughput, very high reliability, and low unit cost with highly uniform good quality of small printed images.

Each of these demands militates strongly in favor of pagewide arrays, which involve much less apparatus motion than scanning machines. As explained earlier, however, each pagewide array is susceptible to objectionable light-area banding in the printed images.

Hence the above objectives of a photo-kiosk printer are advanced by resolution of the banding problem. The reasons for the banding are as follows.

A pagewide array is made of multiple short inkjet printing elements, "dice", positioned generally end-to-end but staggered from side to side as will be seen. For various reasons, image portions printed near the seams between adjacent dice are discontinuous—i.e., they do not blend or merge perfectly. The most severe color errors or defects are narrow bands (usually light-colored) at the seams. The inventors have noted two distinct properties of those band defects:

(1) Even though the ends of the dice are very well defined and their positions precisely known, the relative positions of the resulting light-area bands vary from printer to printer. Band positions also are not precisely predictable from the known positions of those ends.

(2) The profiles of the color errors (i.e. lightness vs. position along the array) are not regular step-functions or even symmetrical about each seam. These profiles, too, vary unpredictably among printers.

Preferred embodiments of the present invention address the first of these properties by characterizing each band, separately, as to position—semiautomatically, i.e. with the help of human user observations of printed test patterns. This first step produces a set of working definitions of the band positions.

After that the invention addresses the second property by characterizing the color-error profiles, again for each band separately—and again semiautomatically, by human observations of test patterns. In printing all of the patterns, preferred embodiments of the invention use certain colors ("user colors") that are representative of image regions particularly vulnerable to the undesired banding, and very frequently occurring.

The above-mentioned user inputs are all made by selecting best patterns and specifically by holding up cards with the several patterns, and putting down the cards that are least good. This procedure differs distinctly from asking a user to point to a particular portion of a pattern that appears best. In particular, in preferred embodiments of our invention the patterns canvass the most common lightness-amplitude ranges and color character of the color errors.

As best practiced, the printed patterns include color ramps whose gradations are essentially at right angles to the banding patterns. Hence these special patterns offer the operator an opportunity to visually gauge the effectiveness of each candidate pattern in context over a great range of tones—simultaneously. With practice an operator using these tools can learn to trade off the relative preferabilities of best imaging quality at different tonal regions.

Preferred embodiments of the invention applies the user-selected color profiles, at the user-selected locations—but only with respect to particular colorants—to compensate for the color errors and thereby equalize the overall output color. For other colorants, in the interest of efficiency, preferred embodiments instead apply profiles selected by the inventors as part of system design, based upon relative lack of impact on banding, and upon relatively nonvarying behavior for those colorants.

Finally, preferred embodiments of the present invention make banding corrections that are not alien to the overall scheme of inkjet-printing linearization—but rather are directly incorporated into that scheme. Each pagewide-array seam (boundary between adjacent dice) is effectively dissected into a series of subboundaries, and each of these is provided with its own custom linearization function. All these intermediate linearization functions are smooth interpolations between the linearization functions for the two adjacent dice.

Earlier patent documents dealing with imaging quality of pagewide arrays touch on user-aided, semiautomatic, interpretation of a printed test pattern (U.S. Pat. No. 6,089,693 of Drake), or printing "very small amounts of additional ink" but "in a substantially random pattern, in areas prone to die-to-die boundary defects" (WO 2006/081051, Brookmire). No known earlier document teaches user selection of best overall correction pattern, or printing of multiple test patterns printed on cards held up together for comparative inspection.

No known earlier patent document teaches printing of candidate corrective inking that is superimposed on a color ramp (using "user colors"), or encourages an operator to trade off good imaging capabilities in different tonal ranges. No such known earlier document integrates banding correction into the linearization regimen of the inkjet printing process generally.

2. Technical Considerations

Figure 2:
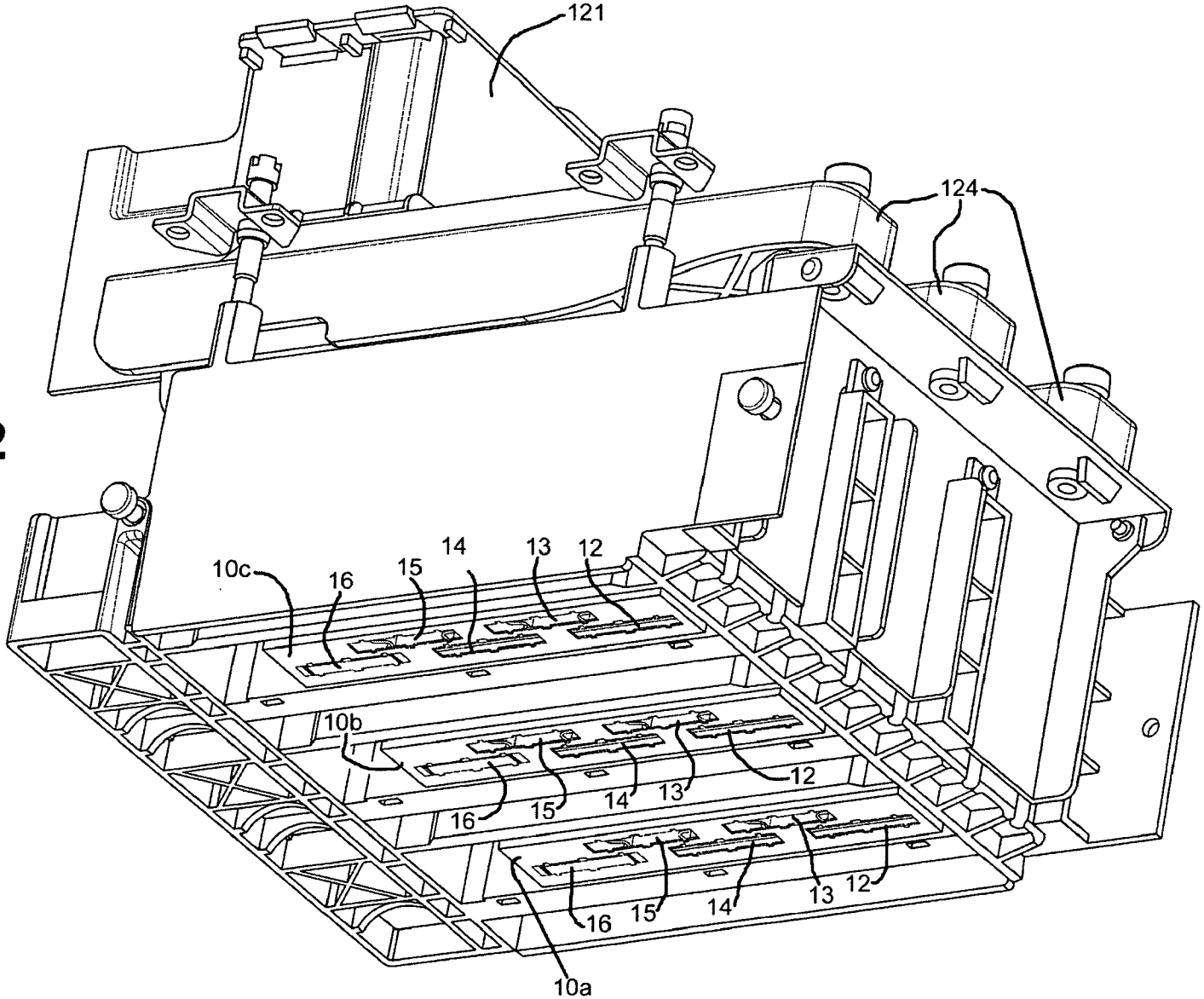
FIG. 2 is a like view, but taken from below and to the left, of the three FIG. 1 pagewide two-color arrays, some of the individual die locations being shown with dice installed, and others being shown empty, revealing the interior of the pen floors.
Figure 3:
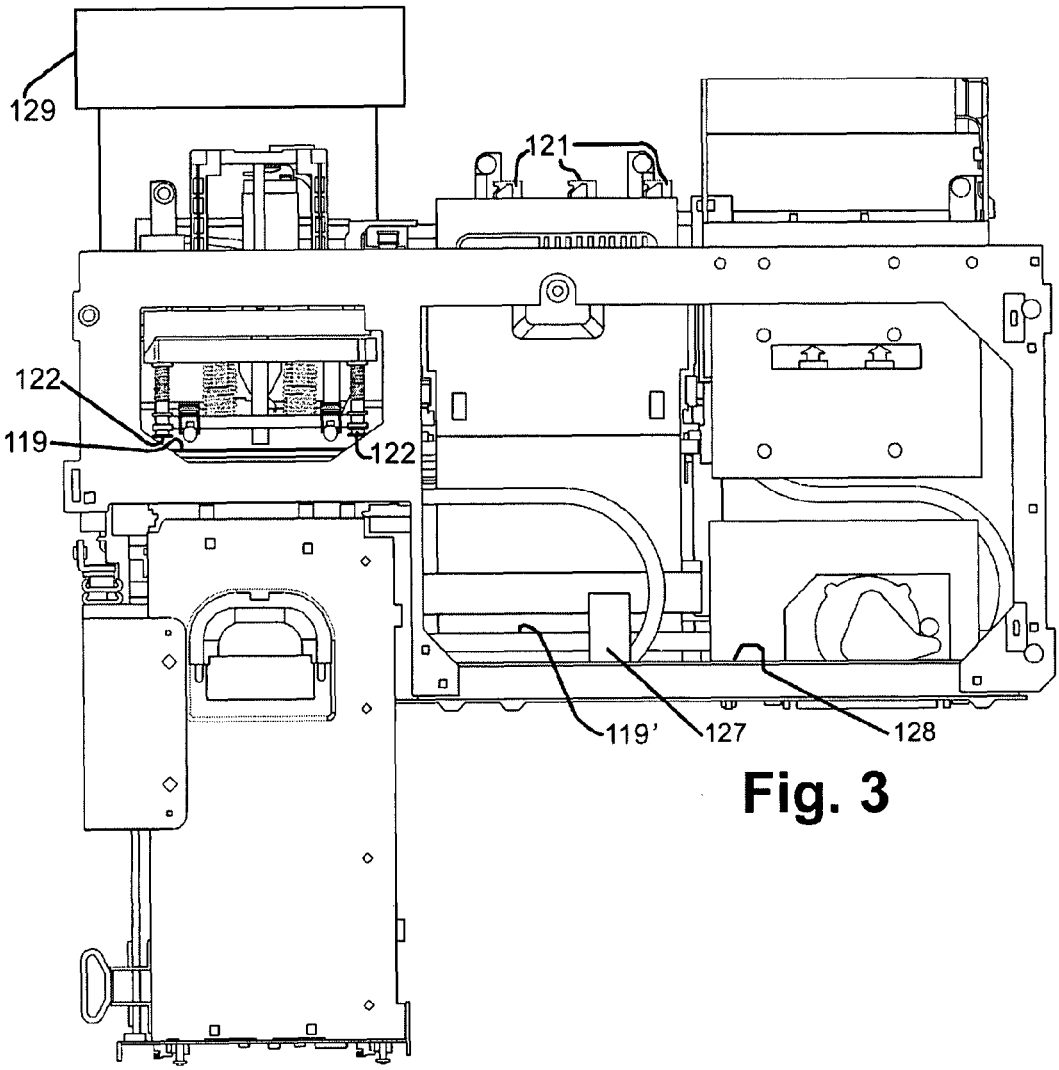
FIG. 3 is a view very generally like FIG. 1 but taken from directly in front of the printer, and particularly showing portions of the mechanism where a finished piece of printing medium (e.g. glossy photo-printing paper) is discharged into an output bin for collection by a user.

MECHANICS—Preferred embodiments of the invention are incorporated into a commercial printing processor that has three dual pen assemblies 124 (FIGS. 1 and 2), controlled through electronics boards 121 by a programmed computer—suitably housed and supported as in, merely by way of example, a representative small module 129—to form color images on pieces of printing medium 19. Ideally each piece is special glossy paper and preferably four inches wide by six inches tall.

An operator inserts a stack of the print medium 19 through an access port 123 onto an input tray 119, from which a suction-foot mechanism 122 positively transfers individual sheets, one at a time, into printing positions on an automatically movable tray 130 beneath the pens 124.

Figure 4:
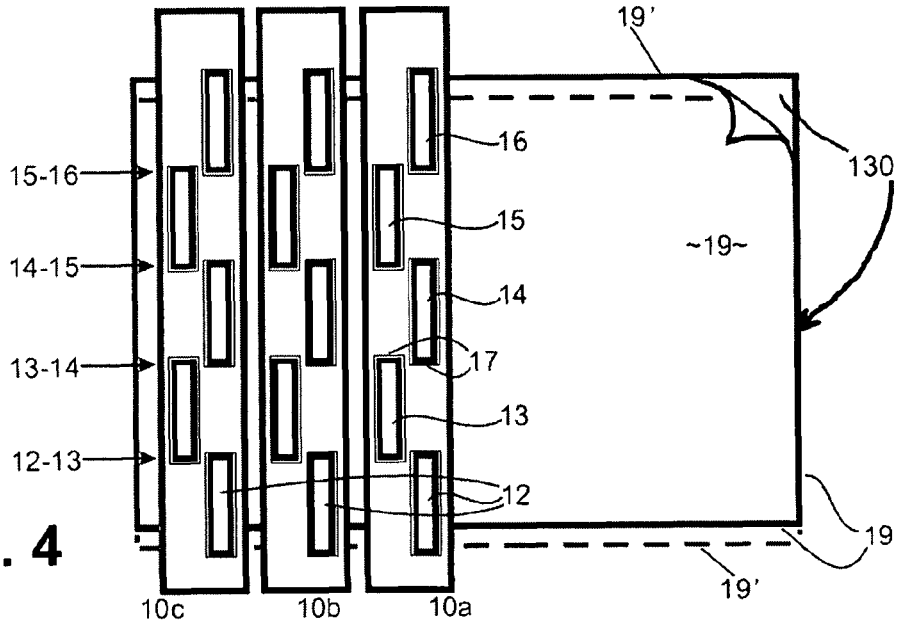
FIG. 4 is a diagram, very schematic, representing a plan or straight-on view of a piece of printing medium (such as photo printing paper) supported on an automated movable tray under the three dual pagewide arrays, in position for printing—showing relationships between the medium and the arrays, and particularly showing boundary regions between individual inkjet printing dice.

In the course of printing, first the tray 130 carries the medium 19 under the arrays 10*a*-10*c* parallel to the long dimension (leftward-rightward in FIG. 4) of the tray and medium, thereby effecting a first printing pass. Then the tray 130 shifts transversely (e.g. partway between two extreme transverse positions of the medium 19, 19', or in other words up-down in FIG. 4) to bring the medium 19 into position for another longitudinal printing pass.

Preferred embodiments of the invention repeat this procedure until all five print passes are complete. The writing system of this printer allows relatively limited movement of the tray 130 and print medium 19 in the transverse direction; as a consequence, the majority of printed areas in each image are printed by nozzles of only one, respectively, of the five dice 12 through 16.

At the bottom ends 10*a*, 10*b*, 10*c* (FIGS. 2 and 4) of the pens are the dice 12-16 that make up the pagewide arrays. Mechanical structure 17 around, and particularly at the ends, of each die obstructs placement of the end nozzles themselves immediately contiguous with end nozzles of an adjacent die. Therefore, to form the array, the dice are offset laterally in an alternating staggered pattern.

More specifically, while some of the dice 12, 14, 16 in each array are along a common straight line, others 13, 15 are in a different straight line that is offset from the first line. For a fully functioning mechanism, all of the die holders are fitted with operating dice (as is illustrated for only some of the individual dice 12, 13 of FIG. 2).

Between each two adjacent dice are the seam or boundary regions 12-13, 13-14, 14-15, 15-16 (FIG. 4) that are associated with the light-area banding that the present invention aims to mitigate. The various ways in which the physical characteristics of these boundaries tend to produce banding are discussed throughout this document.

People skilled in this field will understand that all of the dice used in the preferred embodiments are dual inkjet devices—i.e. each die has at least a pair of nozzle sets, for ejecting two different colorants respectively. In this way the three sets of dice (three page-wide arrays) are able to print with six colorants. It will also be clear that the timing of control signals from the electronics boards 121 is programmed to compensate for the differences between nozzle positions (relative to the movement of the print medium 19 under the nozzles).

In this geometry, the end nozzles of each die radiate heat outward longitudinally, away from the end of the die, with no compensating inward radiation from beyond the end of the die. The more-centrally located nozzles are not subject to such thermal imbalance, since their neighboring nozzles contribute and receive generally equal amounts of heat.

Hence the net outward thermal radiation from the end nozzles tends to cool them, at least contributing to lower temperature of end nozzles relative to their more-central neighbors. Being cooler, the end nozzles in general fire smaller inkdrops.

Also related to the geometry of adjacent dice is die-to-die alignment, particularly since alignment precision and accuracy—in the pagewide arrays 10*a*, 10*b*, 10*c* (FIG. 2) used for preferred embodiments of our invention—are one-half pixel (i.e. one-half nozzle-spacing) at best. In theory, inkdrop dots should spread to a limit based only upon ink-media interactive effects of viscosity, liquid absorption, and the like; however, to the extent that interdie alignment is imperfect the dots overlap, leaving some white spaces in the boundary regions. These effects cause image regions printed by die boundaries to be lighter than regions printed by die bodies.

This geometry accordingly is at least part of the reason that the end nozzles eject less ink than the more-central nozzles. These differences in function in turn are intimately related to the light-area banding which the present invention addresses. Our objective is to correct or mitigate such banding due to all these several causes, as will be more fully discussed and shown shortly.

After printing, the resultant picture on the piece of printing medium 19 proceeds into adjacent processing modules for drying and other finishing, followed by discharge one print at a time into an output tray 119' with a limit bar 127. These individual prints can accumulate as a new stack, which the operator removes for handing to a customer or other end-user.

CALIBRATION AND LINEARIZATION—Because each image area typically is formed by just one respective die of the five dice 12 through 16, image uniformity is highly sensitive to consistent density and drop weights as between the five dice. For this reason each die is preferably color calibrated, to achieve consistent color intensity across the width (transverse dimension) of the page.

Such color calibration particularly includes independent inking measurements for linearization (as detailed below) of each die. Preferred embodiments of the present invention exploit this data-gathering step to integrate correction of light-area banding into the overall linearization of the system.

Actual image-lightness measurements 11 (FIG. 5) taken along the length of a representative array confirm that in die-to-die boundary regions or "seams" 21 through 24, inking is plainly lighter than in the die-body regions 12 through 16. (In principle, semantically there is a distinction between the regions printed by the several dice, identified in FIG. 5—and the corresponding respective physical dice themselves, of FIGS. 2 and 4. Nevertheless, for simplicity's sake the same callout numbers have been used for both.)

Figure 5:
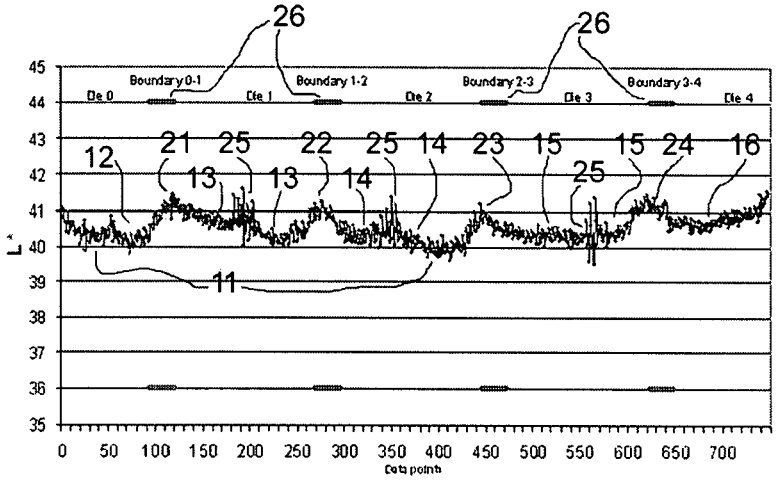
FIG. 5 is a graph of actually measured lightness vs. position along a representative pagewide array, and in particular showing representative lightness variation at boundary regions (or so-called "seams") between adjacent dice—and also showing other variations in lightness along the array.

Due to pen defects, light banding is sometimes observed within regions 25 printed by a die body (FIG. 5). Generally such defects are not severe and can be neglected, particularly as they are not systematic across the product line.

Also, some dice have weaker nozzles than other dice. Most commonly such effects can be compensated through calibration, with refinement in linearization.

It is also common to encounter a die 12, 15 that produces smaller drop weight at one end than the other. This condition is often associated with asymmetry of lightness peaks 21, 24.

Hence the boundary regions 26 are by no means flat, and for analysis and correction in preferred embodiments of our invention we subdivide each boundary 26 into multiple sub-boundaries for separate treatment. Thus, while a representative die 12, 13 etc. has one thousand fifty-six nozzles, we define a boundary region 26—made up of some nozzles from the ends of the two adjacent dice—as encompassing two hundred nozzles. We divide each two-hundred-nozzle boundary, in turn, into eight subgroups.

Based on our extensive trial-and-error experience, preferably there are thirty nozzles in each of the middle four subgroups, leaving twenty nozzles each for the remaining four subgroups—i.e. two subgroups at each end of the boundary. Further, we allow the entire two-hundred-nozzle boundary to, in effect, shift back and forth, over the seam between two dice, controlled by the procedures of our invention as set forth below.

Now given this basic preparation, preferred embodiments of our invention go on to minimize light-area banding. This is done by assigning a respective linearization function to each subgroup of each boundary region 26. (For purposes of definiteness and simplicity, this document discusses the linearization functions and tables as associated with nozzles. Very strictly speaking, the linearization tables are associated with image rows rather than nozzles, and we roughly know which rows use which nozzles. Due to reservation of end nozzles for alignment purposes, as is conventional, very often the top and bottom few nozzles are not used. This is an additional reason that it is necessary to locate the effective boundary positions by the boundary-shifting procedures described.)

This type of banding is usually most conspicuous in large uniform area-fill patterns at all densities and in all colors. The most common such area-fill patterns in snapshots, however, are blue skies and gray backgrounds. Photographs with busy content do not usually show light-area, light-color banding conspicuously.

The preferred embodiments use linearization functions (tables, or curves) that are adjustable, in performing die-to-die and die-boundary color calibration. They cause the pens to fire more drops of ink at areas that would otherwise be too light—such as portions of dice that produce low inkdrop weights without the corrections.

Linearization is performed with reference to minimum lightness (L*), leading to calibration that is device independent. Hence the calibration is consistent not only among dice within each printer but also among printers, from unit to unit.

Preferably a separate linearization function is provided for each die body, and for each of eight subboundaries between adjacent dice. For each of six colorants, there are five such die bodies and thus four boundaries, i.e. four sets of eight subboundaries—for a grand total of, potentially, up to $6\cdot(5+4\cdot 8)=222$ unique linearization functions in the system.

In practice we prefer to implement this scheme by applying user choices to select among so-called "pipeline files". Each such file lists which nozzles will operate according to each linearization function—or, to put it the other way around, which linearization function is assigned to each nozzle. For each colorant at each boundary there are seven pipeline files from which to choose.

In generating test patterns, preferred embodiments of our invention use tonal ramps, preferably three-dimensional ones. People skilled in this field are familiar with the concept of a ramp, as for instance an idealized one-dimensional ramp (FIG. 6) that sweeps through a range of tones from zero density 31 through maximum or 100% density 32, monotonically—and typically in uniform gradations.

Naturally such an ideal one-dimensional (no colorant-mixing) ramp passes through intermediate values such as density three-eighths (i.e. 37½%) 33 and density three-quarters 34 (75%). For purposes of the illustrations in this document, such a one-dimensional ramp is symbolized by a solid arrow 31-32.

A practical three-dimensional ramp is symbolized by a like arrow RGB (FIGS. 14 through 17). By "three-dimensional ramp" we mean a ramp that varies colorants in a three-dimensional color space. As will be seen, this kind of ramp is actually what preferred embodiments of our invention use for printing a gray gradient on the test-pattern cards.

Linearization is a common step in the imaging pipeline of every inkjet printer. In such a printer, the amount of ink deposited on a printing medium is not linearly related with visual perception.

In an ideal inking system that prints tonal values 31-32 (FIG. 6) with no inkdrop overlap at all, inking and visually perceived density are linear. Practical inkjet devices cannot accomplish this ideal, at least not in all image regions.

With such a real-world inkjet device, in areas of low image-data intensity the inkdrops on the medium are spaced apart so that each drop covers its own separate small white region of the medium; in those areas the linear or proportional ideal is followed rather well. In areas of high image-data intensity, however, the inkdrops are not spaced apart. Instead, a newly fired drop is likely to fall—at least in part—on top of drops fired earlier.

In consequence the white-space coverage contribution of each new drop is not proportional to the amounts of ink deposited newly and previously. White-space coverage is less than a proportional fraction.

Figure 6:
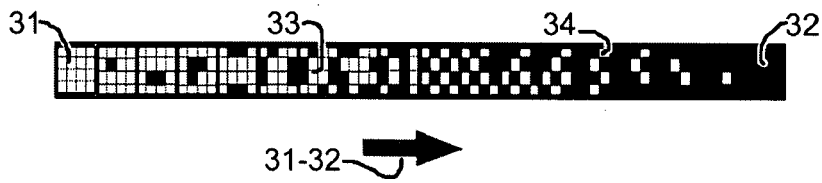
FIG. 6 is a diagram of a printed seventeen-step gray "ramp" (i.e., a succession of closely incremental gray tones from near-zero density through full black), or other one-dimensional ramp such as is used in conventional linearization work, but not directly in practice of the present invention; however, the ramp concept is intimately involved in the present invention and, as will be seen, derivative kinds of ramps are used in preferred test-pattern embodiments of the present invention—and, as explained in another section of this document, this diagram also in effect defines a symbol that represents a generalized printed ramp (i.e., a ramp but not necessarily seventeen-step gray), for use in later drawings; this FIG. 6 tonal ramp is an idealized, linear ramp constructed as a series of seventeen square patches, with each patch subdivided into a four-by-four grid of smaller squares that are selectively marked with nonoverlapping black "inkdrops", but it is the seventeen patches (not the smaller squares) whose average optical densities each make up the respective seventeen tones of the ramp.
Figure 7:
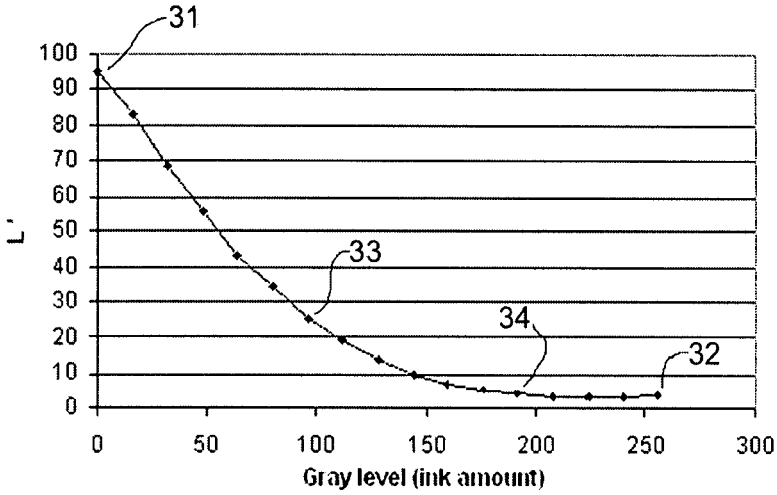
FIG. 7 is a graph of actually measured lightness vs. amount of black ink discharged onto printing medium in an actual inkjet-printed ramp (not the idealized FIG. 6 ramp)—and thus representing lightness vs. image-signal raw gray level, where "raw" means that the image signal is not corrected (linearized) for cumulative inking effects in a representative inkjet printing system as explained in this document.

This behavior fails to conform to the ideal ramp 31-32 (FIG. 6). Lightness L* instead drops quickly at lower densities 31-33 (FIG. 7), and becomes flat at high densities 34-32.

In this real-world regime, if the inking amount is linearly based upon the input image-data tonal level, then the printed output lightness L* is strongly nonlinear in both those values. Human perception of tonal levels follows L* values rather closely; hence critical human observers find such a nonlinear imaging system unacceptable.

Figure 8:
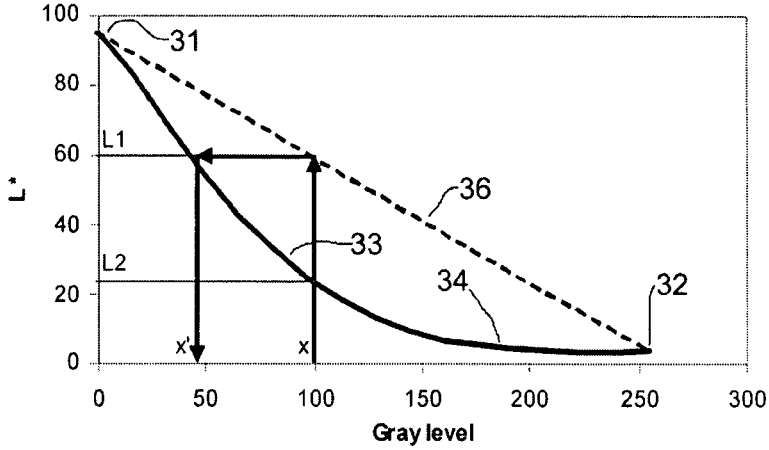
FIG. 8 is a like graph showing for tutorial purposes how the FIG. 7 relationship would lead to output-image tonal errors if not corrected—and further introducing a procedure for advantageous correction ("linearization") of that relationship to obtain printed output images substantially free of such tonal errors.

What makes it unacceptable is that careful observers expect a color patch printed at input image-data level x (FIG. 8)—and a corresponding gray inking level x—to yield a printed output tone at tonal level L1, a value that lies along a rectilinear relationship 36 with the image-data and inking levels. Observers instead see a tone of far lower lightness L2.

Such observers may also compare tonal increments as reproduced in different parts of the overall tonal range. In such comparison, the observers notice that equal tonal increments between input image-data levels as displayed on, e.g., a computer monitor produce unequal tonal increments in the printed output image.

For example, critical observers see that small tonal differences in highlight portions of an image are exaggerated, whereas large tonal differences in shadow portions are subdued. To many people, such discrepancies between the respective tonal responses in shadow and highlight regions are jarring.

The role of linearization, then, is to correct this objectionable nonlinearity. To accomplish this, it is desired to find an input gray level x' that yields the proper, higher level L1 along the nonlinear curve 31-33-34-32.

Figure 9:
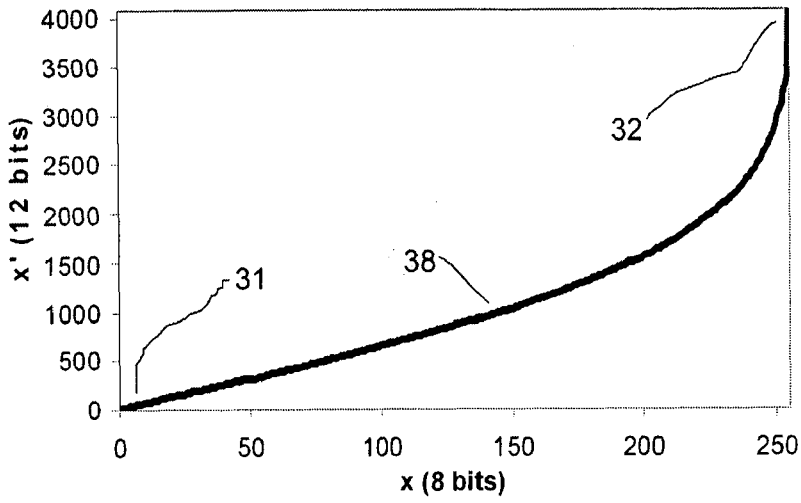
FIG. 9 is a linearization curve or graph representing an example of the FIG. 8 corrections (linearizations) when generated across the entire FIG. 8 tonal range—this graph having a hybrid of different scales along the abscissa and ordinate, for best accuracy in the output (the latter) axis and accordingly in the printed tonal values.

What is preferred is a function that locates such levels x' not only for individual isolated tones but across the full operating tonal range of the system. Such a function that deforms all x to x' is called a "linearization function", or when graphed a linearization curve 38 (FIG. 9)—or when tabulated (e.g. as a lookup table) a linearization table (or "lin-table" for short).

Preferred embodiments of our invention use a linearization method to perform calibration. For best results in generating such calibration and linearization data, input measurements should take into account the relationships between linearizа-tion and drop weight. Inkjet dice vary in drop weight and, as is well known to people skilled in this field, can be rather easily categorized by weight.

For each colorant, during linearization of a particular die, the procedure determines the lowest lightness L* (highest tonal density) that the die can achieve. Since low lightness corresponds to high ink coverage, the lowest L* is in effect a measure of the capability of the die to produce ink coverage.

If a die is operated to apply the maximum permissible amount of ink (corresponding to inking density 255 on a scale of zero through 255), the resulting L* depends upon the drop weight. For example, with such maximum inking, a high-drop-weight die may print a relatively dark L*=35; and a low-drop-weight die may print a lighter L*=40.

In such a case, the minimum usable lightness for this ink is defined as L*=40. To achieve this darkest possible inking, the low-weight die must eject the maximum number of inkdrops; but the high-weight die can accomplish the same inking darkness with a much smaller number of drops.

Figure 10:
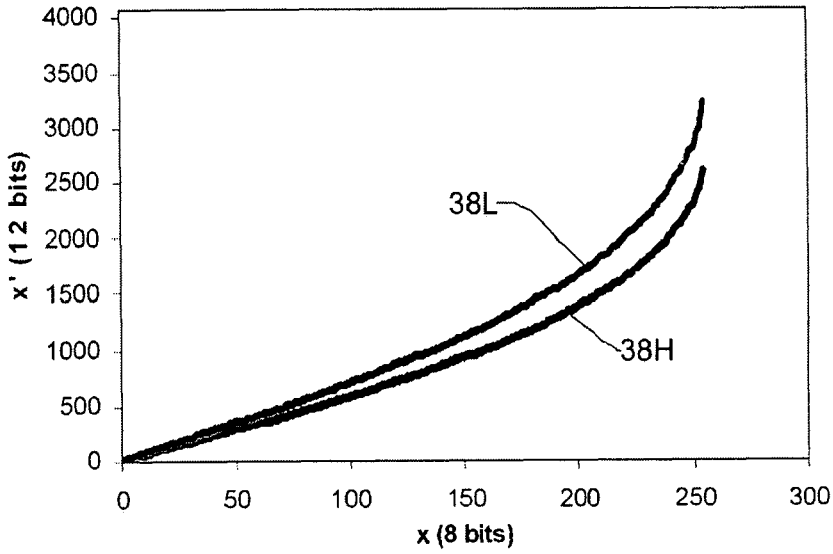
FIG. 10 is a like graph but showing linearization curves for two different inkjet drop weights, as ejected by representative individual inkjet dice in some typical production lines.

Among other notable results, linearization functions 38H, 38L (FIG. 10) for high- and low-weight dice diverge strongly and reach distinctly different endpoints for x'. Since this color calibration method uses the device-independent parameter L* as a reference (or "standard"), the method achieves not only die-to-die color consistency within a printer, but also printer-to-printer color consistency. This uniformity is especially valuable for operation in a commercial photo kiosk environment—which all but invites customers to compare printed results from different individual retail outlets.

Figure 11:
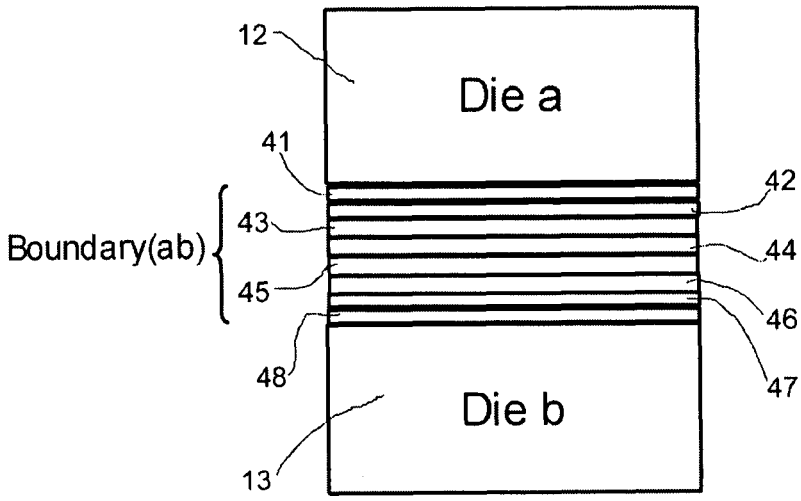
FIG. 11 is a diagram, highly schematic, representing boundary and subboundary positions according to preferred embodiments of the present invention—in a seam region between two representative inkjet printing dice, all as extensively explained below.

Preferred embodiments of the present invention are particularly effective in controlling light-area banding, because they integrate die-boundary calibration, and linearization, into the more-generalized control of color consistency discussed above. Although in theory each interdie boundary 41-48 or "boundary(ab)" (FIG. 11) is one hundred twenty nozzles wide, we prefer to treat each boundary width as two hundred nozzles. This approach facilitates greater smoothness, and makes additional accommodation for possible cases of unusually irregular or long boundaries.

The preferred procedures of our invention construct multiple candidate positions for each such two-hundred-nozzle boundary along the overall pagewide array, between the two adjacent dice 12, 13 (dice "a" and "b" respectively). These procedures evaluate image quality, particularly as to light-color banding, to identify preliminarily which of the candidate positions best masks and camouflages the undesired bands.

Those best candidates are then used in later selecting and refining the colorant profiles that simultaneously linearize and smooth out the light-color bands. Both the preliminary and later selection processes operate by printing test patterns and obtaining operator feedback.

Figure 12:
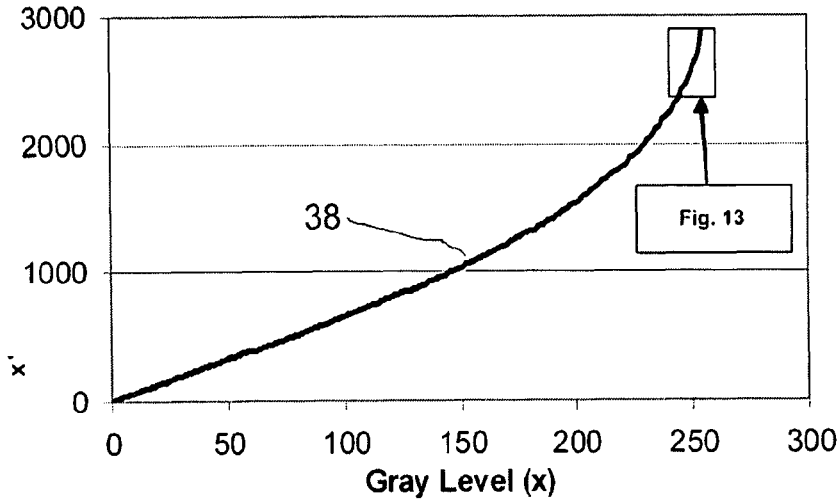
FIG. 12 is a graph like FIGS. 9 and 10, for two adjacent dice, particularly at the die-to-die boundary shown schematically in FIG. 11—but particularly displaying only a single value of corrected inking over almost the entire operating range, where the several linearization values would be nearly indistinguishable.

As mentioned earlier, we also subdivide each such interdie boundary into eight subboundaries 41, 42, . . . 47, 48, and determine optimum discrete linearization functions for all of those subboundaries as well as the adjacent dice. From the origin (very light tones) up through midtones, for example x=150, the optimum functions are clustered very closely (FIG. 12) and form an almost-unitary curve 38, almost indistinguishable from a single common line, when considered visually in a graph.

Figure 13:
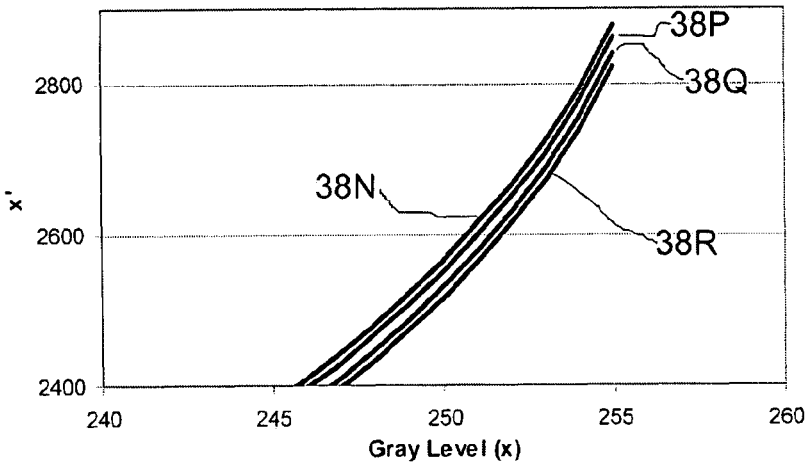
FIG. 13 is a like graph but for only the top end of the operating range, where all the curves become very steep—this graph being greatly enlarged as to both abscissa and ordinate, and in this region showing distinct differences for the different dies and boundary positions.

From roughly x=150 to 230, the functions for the different subboundaries and the adjacent dice begin to diverge more conspicuously, and above about x=240 yield distinctly different values of x'. In a simplified five-subboundary analysis, a lightest linearization characteristic 38N (FIG. 13) may be found for a central subboundary 43 through 46.

In comparison a darkest characteristic 38R is typically determined for the dice 12, 13. Linearization characteristics 38P, 38Q of intermediate darkness generally appear for subboundaries 41, 42, 47, 48 that lie between the dice 12, 13 and the central subboundary 43-46. Thus in general, lightest subboundaries are found near the center of the overall boundary 41 through 48, with progressive gradation toward the adjacent dice.

Through trial-and-error experience, however, we have learned that there is great value in dissecting the overall boundary into a relatively large number—such as eight—of subboundaries, and taking the time to optimize linearizations for the full assemblage of boundary slices.

This approach produces light-color banding mitigation that is very well worth the effort. The result is a relatively robust reduction of banding, i.e. an improvement that is highly resistant to the most extreme cases of interdie tonal mismatch, interdie misalignment, asymmetrical lightness peaks 21 through 24 (FIG. 7), unusually high and low drop weights, thermal anomalies and other irregularities.

As noted earlier, the lightness L* profiles at interdie boundaries 21 through 24 are often asymmetrical. Several reasons appear for asymmetry, including imprecision in the printing-medium advance (in the transverse direction on the medium) between printing passes. Generating asymmetrical linearization tables to match actual measured boundaries could be prohibitively expensive in time and other resources.

Shifting candidate linearization patterns along the pagewide array to find the best location is far less demanding. This process is replicated at each boundary and then followed by a like optimization for profiles of the colorants to which the banding is most sensitive.

On the other hand it must be recognized that our invention can only mitigate, and cannot entirely eliminate, the subject banding. This limitation is inherent in the fact that human-supplied images are semiinfinitely varied and arbitrary. No corrective paradigm can fully anticipate all the myriad ways in which a color fill, or wash, or shade, or gradient pattern can intersect the boundary regions between inkjet dice.

INTERPOLATION—Preferred embodiments of our invention produce smoothly blended interpolation of the linearization functions for boundary slices 41 through 48, between the linearization functions for the adjacent dice 12, 13. Such smooth interpolation is provided by applying simple mathematical expressions as set forth below. These expressions, in a very regular manner, interrelate the linearization functions of all the subboundaries with those of the dice.

Fundamental inputs to this process are linearization tables for each of the five dice 12, 13 (FIG. 11) etc., respectively. Preferably each of these tables is prepared on the basis of actual inking measurements for the corresponding individual die using the mapping principles discussed above in connection with FIGS. 6 through 12.

The measurements preferably are made using a densitometer built into and operating in the printer. Hence at the outset each die is well characterized—except that the densitometer resolution is not adequate for precisely distinguishing individual values in the subboundaries.

In this document one representative linearization table appears at the end of this subsection. It has two hundred fifty-six entries spanning the range of image-data density x (FIGS. 9, 10, 12 and 13) from zero to full-scale—i.e. eight-bit input. For the reason mentioned previously, the tabulated output values are twelve-bit data.

In the notation used below, "Die(a)" represents the numerical value found in the linearization table for a die at one end of an overall boundary "ab", and "Die(b)" similarly represents the value found in the table for the die at the other end of the same boundary.

Additional inputs, for each colorant and each die-to-die boundary, are constants $x_1$, $x_2$, y and z. (The parameters $x_1$ and $x_2$ are not the same as the image-data density x above.) In our earlier work we treated these numbers as variables, but in the evolution of our understanding of the subject pagewide arrays we have been able to fix them as constants without significant loss of generality.

We prefer to tabulate each constant as a respective numerical array. Every row of the array contains values for a particular respective die-to-die boundary, and each column contains values for a particular colorant, namely K, C, M, Y (black, cyan, magenta and yellow respectively)—as well as k (black "light", or in other words gray), and m (magenta light):

| | K | C | M | Y | k | m |
|---|---|---|---|---|---|---|
| $x_1$ | 0.7 | 0.7 | 0.7 | 0.7 | 0.7 | 0.7 |
| | 0.7 | 0.7 | 0.7 | 0.7 | 0.7 | 0.7 |
| | 0.7 | 0.7 | 0.7 | 0.7 | 0.7 | 0.7 |
| | 0.7 | 0.7 | 0.7 | 0.7 | 0.7 | 0.7 |
| $x_2$ | 0.3 | 0.3 | 0.3 | 0.3 | 0.3 | 0.3 |
| | 0.3 | 0.3 | 0.3 | 0.3 | 0.3 | 0.3 |
| | 0.3 | 0.3 | 0.3 | 0.3 | 0.3 | 0.3 |
| | 0.3 | 0.3 | 0.3 | 0.3 | 0.3 | 0.3 |
| y | 1.0 | .985 | 1.0 | 1.0 | 1.0 | 1.0 |
| | 1.0 | .985 | 1.0 | 1.0 | 1.0 | 1.0 |
| | 1.0 | .985 | 1.0 | 1.0 | 1.0 | 1.0 |
| | 1.0 | .985 | 1.0 | 1.0 | 1.0 | 1.0 |
| z | .25 | 0.5 | 1.0 | 1.0 | .15 | 0.5 |
| | .25 | 0.5 | 1.0 | 1.0 | .15 | 0.5 |
| | .25 | 0.5 | 1.0 | 1.0 | .15 | 0.5 |
| | .25 | 0.5 | 1.0 | 1.0 | .15 | 0.5 |

As these tables show, currently all values in the array for $x_1$ are equal (at 0.7), and all values for $x_2$ are equal (at 0.3). Nevertheless we prefer to maintain these constants in array form as shown. This preference retains the flexibility to very easily adapt overall system operation to ongoing production changes, whether in properties of dice or of colorants, or both.

With all these inputs available, the procedure itself takes these four steps:

1) In preparation for interpolation, N "base" values are defined for use in the final step. For our preferred embodiments, N is eight; therefore these values are "$Base_1$" through "$Base_8$":

$Base_3$=0.8 Die(a)+0.2 Die(b)

$Base_4$=0.6 Die(a)+0.4 Die(b)

$Base_5$=0.4 Die(a)+0.6 Die(b)

$Base_6$=0.2 Die(a)+0.8 Die(b)

$Base_1=x_2Base_3+(1-x_2)$ Die(a)

$Base_2=x_1Base_3+(1-x_1)$ Die(a)

$Base_7=x_1Base_6+(1-x_1)$ Die(b)

$Base_8=x_2Base_6+(1-x_2)$ Die(b)

2) At each density value over the system range (e.g. zero through two hundred fifty-five), a factor X is applied to adjust boundary density. (Again, this is not the same as x, or $x_1$, or $x_2$.) The operator, as will be seen, selects this factor X by selection among the test patterns printed by the pagewide array.

We prefer to print seven test patterns, one on each of seven cards, for the operator's inspection. The candidate values of x are, for the seven cards respectively: 1.0, 1.005, 1.01, 1.015, 1.02, 1.025 and 1.03. Thus the candidate additional amounts of colorant to be applied at each boundary are, in percentage measure: zero, one-half, one, one and one-half, two, two and one-half, and three.

3) The operator chooses the best card or cards. An operator is encouraged to choose as few as one card, or as many as three.

Using an identifying number printed on each card, the operator identifies the chosen card or cards to a calibration dialog box, on a screen of the computer or captive controller that is running the analysis program.

4) The printer system calculates the average of the X values entered as the operator's card choice or choices. Then, using the selected factor X and other inputs enumerated above, the system calculates the final N (e.g. eight) linearization tables for each boundary by this equation:

$$Lin_N\,|_{N=1}^{6} = Base_N \cdot X\left[(1-y)\left(\frac{255-i}{255}\right)^2 + y\right]$$

This method, particularly at steps 2 and 4, refrains from modifying the source-image data that define the ramps in additive-color (RGB) terms. The source file is unchanged. The X values instead only increase the printer's application of colorant (and do so in subtractive-color, KCMYkm, terms).

Furthermore the X values increase inking only by factors, from 1 through 1.03. In other words the only color changes along the boundaries are subtle proportional increases in applied colorant, relative to the ramp image specified in the source (.TIF) file.

These changes, as can now be appreciated, represent an effort to perturb lightness L* just enough—in the negative direction—to overcome the lightness artifact due to the boundary effects discussed above. The object, moreover, is to do so without disturbing the hue and saturation (or a* and b* components) native to the ramp as specified by the underlying native image data, or at least without disturbing them conspicuously.

Very importantly, just this same dual paradigm is followed when eventually using the settings derived here to control production printing:

- the end-user's snapshot image files, defining family and nature images in RGB terms, are never changed; and
- the printing is modified only to make small proportional increases in KCMYkm colorant along the boundary strips.

These proportional increases substantially maintain hue and saturation of those original images while applying a small corrective lightness perturbation, carefully localized to the artifact itself.

Following is the two-hundred-fifty-six-entry exemplary input linearization table "Die(a)" or "Die(b)" that was mentioned earlier. Values x of input image-data density are not shown explicitly, but are the row numbers of the table. The output tables, calculated as described above, are very similar except that they contain twelve-bit data—the additional four bits corresponding to a factor of sixteen—for maximum density written as 255·16=4,080.

| K | C | M | Y | k | m |
|---|---|---|---|---|---|
| 0 | 0 | 0 | 0 | 0 | 0 |
| 13 | 14 | 11 | 11 | 17 | 15 |
| 19 | 20 | 15 | 14 | 25 | 22 |

-continued

| K | C | M | Y | k | m |
|---|---|---|---|---|---|
| 25 | 26 | 19 | 17 | 34 | 29 |
| 32 | 32 | 23 | 20 | 42 | 36 |
| 38 | 38 | 27 | 23 | 51 | 43 |
| 44 | 44 | 31 | 26 | 59 | 50 |
| 50 | 50 | 35 | 29 | 68 | 57 |
| 55 | 56 | 39 | 32 | 76 | 64 |
| 61 | 62 | 43 | 35 | 85 | 71 |
| 67 | 68 | 47 | 38 | 94 | 78 |
| 74 | 75 | 51 | 41 | 103 | 85 |
| 80 | 81 | 55 | 44 | 112 | 92 |
| 86 | 87 | 59 | 47 | 120 | 99 |
| 92 | 93 | 63 | 50 | 129 | 106 |
| 98 | 100 | 67 | 53 | 137 | 114 |
| 104 | 106 | 71 | 56 | 146 | 121 |
| 109 | 112 | 76 | 59 | 155 | 128 |
| 115 | 119 | 80 | 62 | 163 | 136 |
| 122 | 125 | 84 | 65 | 172 | 143 |
| 128 | 131 | 88 | 68 | 182 | 150 |
| 134 | 138 | 92 | 71 | 190 | 158 |
| 140 | 144 | 96 | 74 | 199 | 165 |
| 146 | 151 | 100 | 77 | 208 | 173 |
| 152 | 157 | 104 | 81 | 216 | 180 |
| 158 | 164 | 108 | 84 | 225 | 188 |
| 164 | 171 | 113 | 87 | 234 | 195 |
| 170 | 177 | 117 | 90 | 243 | 203 |
| 176 | 184 | 121 | 93 | 252 | 211 |
| 182 | 191 | 125 | 96 | 260 | 218 |
| 188 | 197 | 130 | 100 | 270 | 226 |
| 194 | 204 | 134 | 103 | 279 | 234 |
| 200 | 211 | 138 | 106 | 288 | 242 |
| 207 | 218 | 143 | 109 | 297 | 249 |
| 213 | 224 | 147 | 112 | 306 | 257 |
| 218 | 231 | 152 | 116 | 315 | 265 |
| 224 | 238 | 156 | 119 | 323 | 273 |
| 230 | 245 | 160 | 122 | 332 | 281 |
| 236 | 252 | 165 | 125 | 341 | 289 |
| 243 | 259 | 169 | 129 | 350 | 297 |
| 249 | 266 | 174 | 132 | 360 | 305 |
| 255 | 273 | 178 | 135 | 369 | 313 |
| 261 | 281 | 183 | 139 | 378 | 321 |
| 267 | 289 | 187 | 142 | 387 | 329 |
| 273 | 296 | 191 | 146 | 397 | 338 |
| 279 | 303 | 196 | 149 | 406 | 346 |
| 285 | 310 | 200 | 152 | 415 | 354 |
| 291 | 318 | 205 | 156 | 424 | 362 |
| 298 | 325 | 209 | 159 | 433 | 371 |
| 304 | 332 | 214 | 163 | 442 | 379 |
| 310 | 340 | 219 | 166 | 452 | 388 |
| 316 | 347 | 223 | 169 | 462 | 396 |
| 322 | 355 | 228 | 173 | 471 | 405 |
| 328 | 362 | 233 | 176 | 480 | 413 |
| 334 | 370 | 238 | 180 | 490 | 422 |
| 340 | 377 | 242 | 183 | 499 | 430 |
| 347 | 385 | 247 | 187 | 508 | 439 |
| 353 | 393 | 252 | 191 | 518 | 448 |
| 359 | 400 | 257 | 194 | 527 | 456 |
| 366 | 408 | 262 | 198 | 537 | 465 |
| 372 | 416 | 266 | 201 | 547 | 474 |
| 377 | 424 | 271 | 205 | 556 | 483 |
| 384 | 431 | 276 | 209 | 566 | 492 |
| 390 | 439 | 281 | 212 | 575 | 501 |
| 396 | 447 | 285 | 216 | 585 | 510 |
| 403 | 455 | 290 | 220 | 595 | 519 |
| 409 | 463 | 295 | 223 | 604 | 528 |
| 416 | 472 | 300 | 227 | 614 | 537 |
| 422 | 480 | 305 | 231 | 625 | 546 |
| 428 | 488 | 310 | 235 | 634 | 555 |
| 434 | 496 | 315 | 238 | 644 | 564 |
| 440 | 504 | 320 | 242 | 654 | 574 |
| 447 | 513 | 325 | 246 | 664 | 583 |
| 453 | 521 | 331 | 250 | 673 | 593 |
| 460 | 529 | 336 | 254 | 683 | 602 |
| 466 | 538 | 341 | 258 | 693 | 611 |
| 473 | 546 | 346 | 261 | 703 | 621 |
| 479 | 555 | 351 | 265 | 714 | 631 |
| 485 | 565 | 357 | 269 | 724 | 640 |
| 491 | 573 | 362 | 273 | 734 | 650 |

-continued

| K | C | M | Y | k | m |
|---|---|---|---|---|---|
| 498 | 582 | 367 | 277 | 744 | 660 |
| 504 | 591 | 373 | 281 | 754 | 669 |
| 511 | 600 | 377 | 285 | 765 | 679 |
| 517 | 608 | 382 | 289 | 775 | 689 |
| 524 | 617 | 388 | 293 | 785 | 699 |
| 531 | 626 | 393 | 297 | 795 | 709 |
| 536 | 635 | 399 | 301 | 807 | 719 |
| 543 | 644 | 404 | 305 | 817 | 729 |
| 550 | 653 | 410 | 310 | 827 | 739 |
| 556 | 663 | 415 | 314 | 838 | 749 |
| 563 | 672 | 421 | 318 | 848 | 760 |
| 570 | 681 | 427 | 322 | 859 | 770 |
| 576 | 690 | 432 | 326 | 869 | 780 |
| 583 | 700 | 438 | 331 | 880 | 791 |
| 590 | 709 | 444 | 335 | 891 | 801 |
| 596 | 719 | 449 | 339 | 902 | 811 |
| 602 | 728 | 455 | 343 | 913 | 822 |
| 609 | 738 | 461 | 348 | 924 | 833 |
| 616 | 748 | 467 | 352 | 934 | 843 |
| 623 | 758 | 472 | 357 | 945 | 854 |
| 630 | 767 | 478 | 361 | 956 | 865 |
| 637 | 777 | 484 | 365 | 967 | 876 |
| 643 | 787 | 490 | 370 | 979 | 887 |
| 650 | 797 | 496 | 374 | 990 | 898 |
| 656 | 807 | 502 | 379 | 1001 | 909 |
| 663 | 818 | 508 | 383 | 1012 | 920 |
| 670 | 828 | 514 | 388 | 1023 | 931 |
| 677 | 839 | 520 | 393 | 1035 | 942 |
| 684 | 849 | 526 | 397 | 1046 | 953 |
| 691 | 860 | 533 | 402 | 1057 | 965 |
| 698 | 870 | 539 | 407 | 1070 | 976 |
| 705 | 881 | 545 | 411 | 1081 | 988 |
| 712 | 891 | 551 | 416 | 1092 | 999 |
| 719 | 902 | 558 | 421 | 1104 | 1011 |
| 726 | 913 | 564 | 426 | 1116 | 1022 |
| 733 | 924 | 570 | 431 | 1127 | 1034 |
| 740 | 935 | 576 | 435 | 1139 | 1046 |
| 748 | 946 | 583 | 440 | 1151 | 1058 |
| 754 | 957 | 589 | 445 | 1164 | 1070 |
| 761 | 968 | 596 | 450 | 1175 | 1082 |
| 769 | 979 | 603 | 455 | 1187 | 1094 |
| 776 | 990 | 609 | 460 | 1199 | 1106 |
| 783 | 1002 | 616 | 465 | 1211 | 1118 |
| 791 | 1013 | 623 | 471 | 1223 | 1131 |
| 798 | 1025 | 630 | 476 | 1236 | 1143 |
| 805 | 1036 | 637 | 481 | 1249 | 1156 |
| 812 | 1048 | 644 | 486 | 1261 | 1168 |
| 820 | 1060 | 651 | 491 | 1273 | 1181 |
| 827 | 1072 | 658 | 497 | 1286 | 1194 |
| 835 | 1084 | 664 | 502 | 1298 | 1206 |
| 842 | 1096 | 671 | 507 | 1311 | 1219 |
| 850 | 1108 | 679 | 513 | 1323 | 1232 |
| 858 | 1121 | 686 | 518 | 1337 | 1245 |
| 864 | 1133 | 693 | 524 | 1350 | 1258 |
| 872 | 1146 | 701 | 529 | 1363 | 1272 |
| 880 | 1158 | 708 | 535 | 1376 | 1285 |
| 888 | 1171 | 716 | 541 | 1389 | 1298 |
| 895 | 1184 | 723 | 546 | 1402 | 1312 |
| 903 | 1196 | 731 | 552 | 1415 | 1325 |
| 911 | 1209 | 738 | 558 | 1429 | 1339 |
| 918 | 1222 | 746 | 564 | 1442 | 1353 |
| 926 | 1235 | 753 | 569 | 1455 | 1366 |
| 934 | 1248 | 761 | 575 | 1469 | 1380 |
| 942 | 1262 | 769 | 581 | 1482 | 1394 |
| 950 | 1275 | 777 | 587 | 1496 | 1408 |
| 958 | 1288 | 785 | 594 | 1510 | 1423 |
| 966 | 1302 | 793 | 600 | 1524 | 1437 |
| 974 | 1316 | 801 | 606 | 1538 | 1451 |
| 982 | 1329 | 810 | 612 | 1552 | 1466 |
| 990 | 1343 | 818 | 618 | 1565 | 1480 |
| 999 | 1357 | 826 | 625 | 1579 | 1495 |
| 1007 | 1371 | 835 | 631 | 1594 | 1510 |
| 1016 | 1385 | 844 | 638 | 1609 | 1525 |
| 1023 | 1401 | 851 | 644 | 1623 | 1540 |
| 1032 | 1415 | 860 | 651 | 1637 | 1555 |
| 1040 | 1430 | 869 | 657 | 1652 | 1570 |
| 1049 | 1444 | 878 | 664 | 1666 | 1586 |

-continued

| K | C | M | Y | k | m |
|---|---|---|---|---|---|
| 1058 | 1459 | 887 | 671 | 1681 | 1601 |
| 1066 | 1474 | 896 | 678 | 1696 | 1616 |
| 1074 | 1489 | 905 | 685 | 1711 | 1632 |
| 1083 | 1504 | 915 | 692 | 1726 | 1648 |
| 1092 | 1519 | 924 | 699 | 1741 | 1664 |
| 1101 | 1535 | 934 | 706 | 1756 | 1680 |
| 1110 | 1550 | 942 | 713 | 1771 | 1696 |
| 1119 | 1566 | 952 | 721 | 1787 | 1712 |
| 1127 | 1581 | 962 | 728 | 1803 | 1729 |
| 1136 | 1597 | 972 | 736 | 1818 | 1745 |
| 1146 | 1613 | 982 | 743 | 1833 | 1762 |
| 1155 | 1629 | 992 | 751 | 1849 | 1778 |
| 1164 | 1645 | 1002 | 759 | 1866 | 1795 |
| 1174 | 1662 | 1013 | 766 | 1881 | 1812 |
| 1182 | 1679 | 1023 | 774 | 1897 | 1829 |
| 1192 | 1696 | 1034 | 782 | 1913 | 1846 |
| 1202 | 1712 | 1044 | 790 | 1929 | 1864 |
| 1211 | 1729 | 1054 | 799 | 1945 | 1881 |
| 1221 | 1746 | 1065 | 807 | 1963 | 1899 |
| 1231 | 1763 | 1077 | 816 | 1979 | 1916 |
| 1240 | 1781 | 1088 | 824 | 1995 | 1934 |
| 1250 | 1798 | 1100 | 833 | 2012 | 1952 |
| 1260 | 1816 | 1111 | 842 | 2029 | 1970 |
| 1271 | 1833 | 1123 | 851 | 2046 | 1989 |
| 1281 | 1851 | 1134 | 860 | 2063 | 2007 |
| 1290 | 1869 | 1146 | 869 | 2080 | 2025 |
| 1301 | 1887 | 1158 | 878 | 2097 | 2044 |
| 1312 | 1905 | 1171 | 887 | 2114 | 2063 |
| 1322 | 1924 | 1183 | 897 | 2133 | 2082 |
| 1333 | 1942 | 1196 | 907 | 2150 | 2101 |
| 1343 | 1962 | 1209 | 917 | 2167 | 2120 |
| 1354 | 1981 | 1223 | 927 | 2185 | 2139 |
| 1365 | 2000 | 1235 | 937 | 2203 | 2159 |
| 1377 | 2019 | 1249 | 947 | 2221 | 2178 |
| 1388 | 2038 | 1263 | 958 | 2239 | 2198 |
| 1398 | 2057 | 1277 | 969 | 2257 | 2218 |
| 1410 | 2077 | 1291 | 980 | 2275 | 2238 |
| 1422 | 2096 | 1306 | 991 | 2294 | 2258 |
| 1434 | 2116 | 1319 | 1002 | 2313 | 2278 |
| 1446 | 2136 | 1335 | 1014 | 2331 | 2299 |
| 1457 | 2156 | 1350 | 1026 | 2350 | 2319 |
| 1469 | 2177 | 1366 | 1038 | 2368 | 2340 |
| 1482 | 2197 | 1381 | 1050 | 2387 | 2361 |
| 1494 | 2217 | 1398 | 1062 | 2407 | 2382 |
| 1506 | 2239 | 1413 | 1075 | 2426 | 2403 |
| 1519 | 2260 | 1430 | 1088 | 2445 | 2424 |
| 1532 | 2281 | 1447 | 1101 | 2464 | 2445 |
| 1546 | 2302 | 1465 | 1115 | 2483 | 2467 |
| 1558 | 2323 | 1483 | 1129 | 2504 | 2488 |
| 1572 | 2345 | 1501 | 1143 | 2523 | 2510 |
| 1586 | 2367 | 1519 | 1158 | 2543 | 2532 |
| 1600 | 2388 | 1538 | 1173 | 2563 | 2554 |
| 1613 | 2410 | 1557 | 1188 | 2583 | 2576 |
| 1628 | 2432 | 1577 | 1204 | 2603 | 2598 |
| 1643 | 2455 | 1598 | 1220 | 2623 | 2621 |
| 1658 | 2477 | 1618 | 1237 | 2643 | 2643 |
| 1672 | 2499 | 1639 | 1254 | 2665 | 2666 |
| 1688 | 2523 | 1661 | 1272 | 2685 | 2688 |
| 1703 | 2546 | 1683 | 1290 | 2706 | 2711 |
| 1719 | 2569 | 1705 | 1309 | 2726 | 2734 |
| 1735 | 2592 | 1729 | 1328 | 2747 | 2757 |
| 1752 | 2615 | 1753 | 1348 | 2769 | 2780 |
| 1769 | 2639 | 1778 | 1369 | 2789 | 2803 |
| 1786 | 2663 | 1802 | 1390 | 2810 | 2827 |
| 1804 | 2686 | 1829 | 1413 | 2832 | 2850 |
| 1822 | 2710 | 1856 | 1436 | 2854 | 2874 |
| 1840 | 2734 | 1883 | 1460 | 2875 | 2898 |
| 1859 | 2759 | 1911 | 1485 | 2896 | 2922 |
| 1878 | 2783 | 1940 | 1511 | 2918 | 2945 |
| 1899 | 2809 | 1970 | 1538 | 2941 | 2970 |
| 1920 | 2833 | 2000 | 1566 | 2963 | 2994 |
| 1940 | 2858 | 2032 | 1595 | 2984 | 3018 |
| 1963 | 2883 | 2065 | 1626 | 3006 | 3042 |
| 1985 | 2909 | 2097 | 1659 | 3029 | 3067 |
| 2008 | 2934 | 2132 | 1693 | 3052 | 3091 |
| 2033 | 2960 | 2167 | 1729 | 3074 | 3116 |
| 2057 | 2985 | 2204 | 1766 | 3096 | 3141 |

-continued

| K | C | M | Y | k | m |
|---|---|---|---|---|---|
| 2084 | 3011 | 2241 | 1806 | 3120 | 3166 |
| 2111 | 3037 | 2279 | 1847 | 3143 | 3191 |
| 2140 | 3064 | 2320 | 1891 | 3166 | 3217 |
| 2169 | 3091 | 2360 | 1937 | 3188 | 3242 |
| 2200 | 3118 | 2402 | 1985 | 3212 | 3268 |
| 2234 | 3144 | 2446 | 2036 | 3236 | 3294 |
| 2268 | 3171 | 2490 | 2089 | 3259 | 3320 |
| 2306 | 3198 | 2536 | 2144 | 3283 | 3346 |
| 2346 | 3226 | 2583 | 2202 | 3307 | 3373 |
| 2388 | 3253 | 2632 | 2262 | 3331 | 3399 |
| 2435 | 3281 | 2681 | 2324 | 3354 | 3426 |
| 2485 | 3309 | 2732 | 2389 | 3379 | 3453 |
| 2541 | 3337 | 2786 | 2456 | 3403 | 3481 |
| 2604 | 3366 | 2840 | 2525 | 3428 | 3509 |
| 2675 | 3395 | 2897 | 2599 | 3452 | 3537 |
| 2754 | 3424 | 2955 | 2676 | 3478 | 3566 |
| 2847 | 3453 | 3015 | 2758 | 3502 | 3595 |
| 2954 | 3482 | 3079 | 2846 | 3527 | 3625 |
| 3078 | 3511 | 3144 | 2945 | 3553 | 3655 |
| 3217 | 3541 | 3213 | 3057 | 3578 | 3686 |
| 3369 | 3571 | 3285 | 3198 | 3604 | 3717 |
| 3539 | 3601 | 3360 | 3412 | 3629 | 3750 |

PRINTING TEST-PATTERNS AND RECEIVING HUMAN FEEDBACK—To reiterate, the invention is a two-step interactive process: determination of effective boundary locations first, and then optimization of ink intensities for placement at those boundaries. Both steps are performed by printing test-patterns on pieces of printing medium such as photo paper or cards 1(*a*) through 1(*c*)—FIGS. 14 through 16—for inspection (FIG. 17).

Ideally, theoretical locations for light-area banding are fixed because the mechanical die-to-die boundaries are exactly known. Effective visual boundaries in an image, however, are much less definite:

an individual die does not produce a printed swath with a sharp or step-function edge—instead the printed edges are very irregular; and therefore adjacent dice produce adjacent irregular patterns that fail to fit together in any orderly or tidy way. More specifically, the composite result for L* profile of a die-to-die boundary is often not symmetrical.

Several other disruptive influences on the definiteness of each effective visual boundary are described elsewhere in this document.

This invention identifies the visually effective die-to-die boundaries first. Then it optimizes ink amounts to apply at those locations to make the entire image appear as uniform as can be accomplished practically. Each of the test stages in turn will now be described in greater detail.

Figure 14:
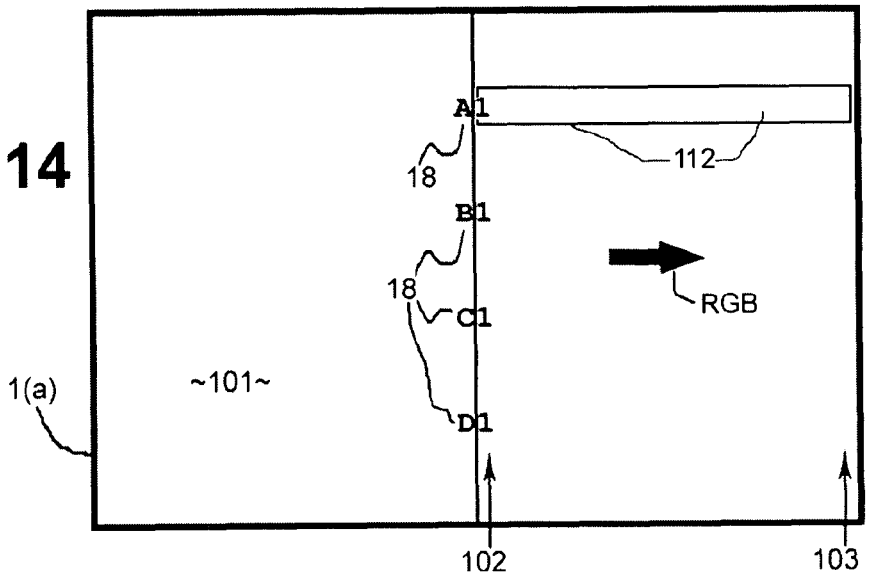
FIG. 14 is a diagram, somewhat schematic, of one of the test-pattern cards, particularly a card that is half white and the other half a "blue sky" ramp—for use in determining the effective boundary locations of a particular pagewide array (colorants used in the several test-pattern ramps are discussed elsewhere in this document)

For determining the boundary locations, preferred embodiments of the invention print a first test-pattern card 1(*a*) that has a white half 101 (FIG. 14). The other half of the card has a three-dimensional color ramp RGB continuously graded from a light-blue strip 102—just inside the card centerline—to a darker-blue edge 103 along the end of the card.

The light-blue strip 102 is formed by red, green and blue colors at respective intensities of 135, 170 and 185 (on a scale of zero through 255). The opposed darker-blue edge 102 is formed by the same three colors but at intensities of 86, 123 and 164 respectively.

Each card is also printed with alphanumeric indicia 18 to draw the operator's attention to the die-boundary regions of the card, where light-area banding occurs. For example one such region 112 (FIG. 14) on card 1(*a*) is adjacent to the printed indicium "A1", and other regions are marked with indicia "B1", "C1" and "D1".

Each indicium ends in "1" because this card 1(*a*) is the first of seven cards used for locating the effective boundary locations. Other test-cards (not shown) in the same set might implicitly be numbered 2(*a*) through 7(*a*). Indicia printed on those six cards are similarly "A2" . . . "D2", on the second card, through "A7" . . . "D7" on the seventh card.

It will be understood that the region 112 is only exemplary and that like regions are similarly adjacent to the other indicia "B1", "C1", "D1" on this card 1(*a*) (even though not shown) and other cards e.g. 2(*a*) through 7(*a*). Furthermore, like regions are adjacent to the indicia printed on the cards 1(*b*), 1(*c*) (FIGS. 15, 16) in other sets, as well as remaining cards of those sets. Actual die-boundary locations are located roughly near, not necessarily immediately adjacent, the boundary labels "A1" . . . "D1".

It is also to be understood that preferably no identification 1(*a*) and no rectangular box 112 or the like is actually printed as part of the test-plot card 1(*a*). The box 112, and the callouts "112" and "1(*a*)" shown are not parts of the printed indicia, but rather are only parts of the drawing (FIG. 14). The rectangular box 112 is included only to show the reader of this document a representative boundary region where banding can occur.

Adjacent to each indicium "A1" . . . "D1" and within each such die-boundary region 112, a strip of the ramp RGB is printed with an extra very small amount of colorant. The colorants in each such strip area are substantially the same colorants as the surrounding parts of the ramp RGB, but printed with just a nominal slightly incremented amount: one percent more than in parallel areas that correspond to the die bodies.

The several candidate locations on the several cards in the set, in effect, shift the boundaries slightly up and down along the overall pagewide array. More literally, the overinked strips are printed at very slightly different heights on the respective different cards, to generate the series of separate test plots (most preferably seven plots).

People skilled in this field will understand that this effect is most easily accomplished by printing the entire test-pattern image (including the color ramp RGB and the overinked strips) at different heights on the cards. Since these positional differences are very small, even the indicia 18 can be shifted with the rest of the test-plot image. The differences, then, are taken up at the bottoms and tops of the cards, where the image portions falling above or below the physical cards can be truncated if desired—or otherwise simply allowed to print as "bleed".

For this location-identifying step, the color used is the one which is probably the single most challenging color in terms of end-user satisfaction—because (1) it occurs in an extremely large fraction of all snapshots, and (2) users are particularly critical of visual artifacts in the context of this color. It is the color of a blue sky.

Thus for purposes of the boundary-location tests, the candidate boundary locations are exhibited superimposed on a blue-sky ramp. Furthermore the ramp is inspected while in essentially the same orientation as in the most-common natural viewing of the sky—namely, with the lighter end of the gradient held downward, and the darker end upward.

In comparing the printed test-patterns, the operator works with all the cards, but only one single die-boundary region at a time. For example, the operator may compare all the test-prints at boundary A (i.e. adjacent to the indicia "A1" through "A7", not shown, for cards 1 through 7); and then may compare all the prints at boundary B, for the same cards 1 through 7, and so on through boundaries C and D.

In accordance with preferred embodiments of the invention, operators preferably are advised to favor test-prints that provide relatively more-uniform density at the boundary, and to avoid sharp transitions in the image—instead favoring banding that is more symmetrical. The operators also are trained to quickly look at a particular boundary in all seven prints and initially eliminate the obviously worst samples 1, 3, 4 (FIG. 17)—by setting them aside.

Next, with the remaining samples 2, 5-7, the operator is to hold up two test-prints at a time, side by side. Better or similar prints are best placed in one pile, and the worse prints 1, 3, 4 in a different pile. After going through all the test-cards once, the operator should compare the prints in the "better" pile, using the same physical arrangements and eliminating more samples if necessary to reduce the number of "better" prints to a certain permitted maximum.

To improve both accuracy and ease of use, operators are trained to identify—for each die boundary in turn—up to three test-plots, those that have minimum light-area banding or other boundary artifact, from the whole set of plots. We have found that sometimes a few of the test-prints in each set look very similar; hence the operator only has to quickly choose the better ones without further identifying which one is best.

The operator identifies the chosen print or prints by using a pointing device such as a mouse 29 to enter their numbers into the dialog box 28 on a computer screen 27.

In such cases an average of the best three choices also is usually more accurate than any one chosen as best. After taking operator feedback, the printer calculates the practical boundary locations and automatically updates the imaging pipeline. When this is done, the operator proceeds to evaluate the same seven cards (using the same procedure as for the die boundary that has been completed) but now with respect to the remaining die boundaries.

Next, the ink-intensity optimizations encompass two substeps: in the first, the printer again generates a set of test-plot cards 1(*b*) etc. (FIG. 15) displaying color ramps RGB, but now with the two most important "primary" colorants—a gray ramp and a light magenta ramp—printed at opposite ends of each test card. (As explained below, so-called "primary" colorants are not the classical primary colors.)

Figure 15:
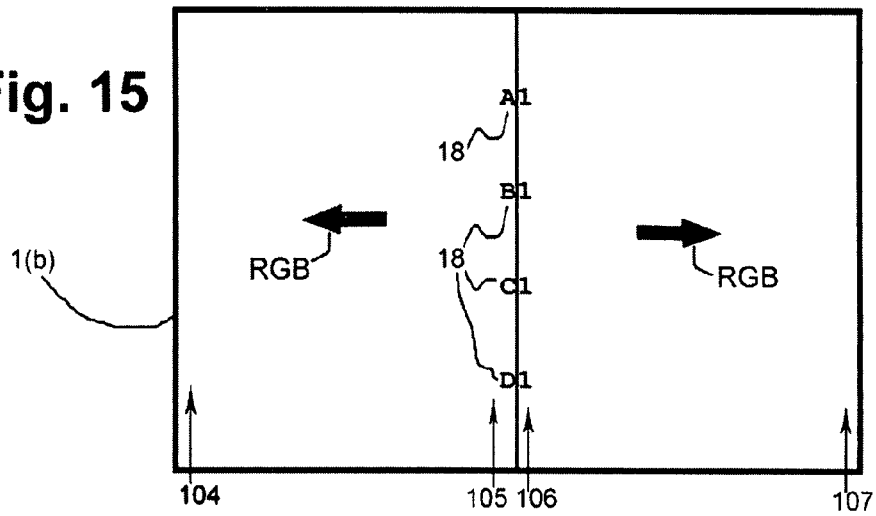
FIG. 15 is a like diagram but for a card that is half a "light magenta" ramp and the other half a "light gray" ramp.
Figure 16:
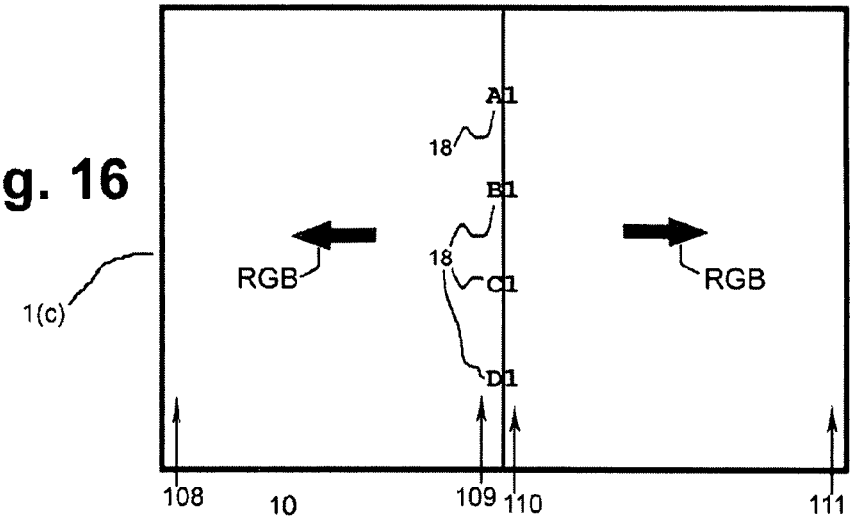
FIG. 16 is a like diagram for a card that is half a "blue sky" ramp, identical to that of FIG. 14, and the other half a "darker gray" ramp.
Figure 17:
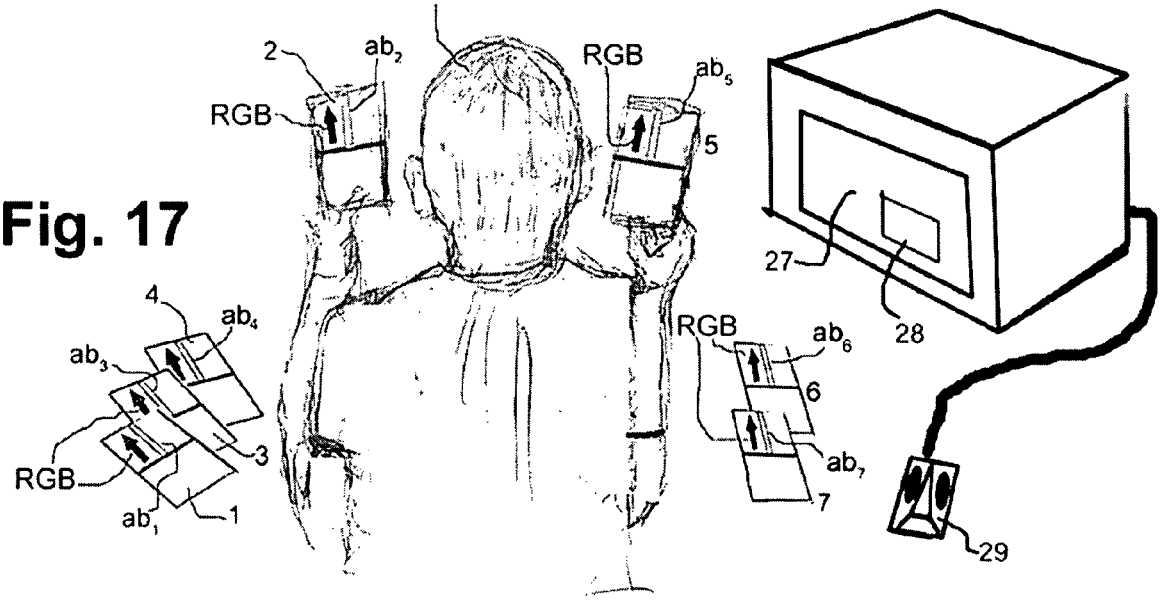
FIG. 17 is a rough line-drawing sketch representing one preferred method, according to the present invention, by which a human operator views the test patterns of FIGS. 14 through 16.

Then the operator repeats all of the same overall procedure for other test-patterns—some of which may be on the same cards but at the other ends, and others of which may be on other cards (FIGS. 14 through 16). For test-plots that are at the "other ends", the operator inverts the cards so that the test-plots under consideration are at the top.

The gray ramp is graded from a very light gray color along a strip 105 of the card that is just inside the card centerline, to a darker gray color in a strip 104 along the edge of the card. The central very light gray strip 105 is made with the colors red, green and blue all in equal amounts, at intensity of hundred (on a scale of zero through two hundred fifty-five); and the outer, opposing darker gray strip 104 is printed with those colors also in equal amounts but at intensity two hundred, on the same scale.

Analogously the system prints the magenta ramp shaded from a very light magenta color in a strip 106 just inside the card centerline to a darker magenta, formed in an opposing strip 107 along the card edge. The light-magenta strip 106 is composed of red and blue both at maximum intensity of two hundred fifty-five, combined with green at intensity two hundred nineteen; the darker magenta edge is red and blue at the same maximum intensity, but with green at intensity one hundred one.

Other cards in this set (FIG. 15), implicitly cards that might be numbered 2(*b*) through 7(*b*), are not shown. In all of these seven plots, unlike the location-test plots, the test-pattern is always printed at a single common height on the card, namely the optimum location found before.

Thus there is no shifting of location at this stage. What is instead shifted is amount of overinking along the located boundary: relative to the background ramp RGB, the added ink spans a range of added ink amounts at the die boundaries, namely zero to three percent more ink than the die bodies.

Again the operators are trained to select and record in the computer up to three plots with minimum boundary artifacts, and the printer pipeline (particularly gray and light-magenta linearization tables) is automatically updated with the operator's decisions.

In the second substep of the ink-intensity optimizations, the printer once again generates a set of test-plot ramps RGB (FIG. 16). Here too the preferred number of test-pattern cards 1(*c*) etc. is seven, but now printing with the two most important composite colorants: a blue sky, and a composite-black ramp, at each end of the page.

Except for the superimposed incremental-inking patterns along the die-boundary regions, the blue-sky gradient used here is identical to that employed in the earlier boundary-locating step, i.e. graded from light blue along a near-central strip 110 (FIG. 16)—which is the same color as the near-central strip 102 (FIG. 14)—to dark blue along an outer-edge strip 111 (FIG. 16). The dark blue strip 111 is likewise the same color as outer strip 103 (FIG. 14).

As in the first ink-optimizing stage, these patterns span a range of surplus inking, at the die boundaries, specifically from zero to three percent more colorant than applied by the die bodies. Here too operators are trained to choose and enter up to three test-patterns that exhibit minimum light-area banding; and the operator's decisions are applied to update the printer control system (here especially the cyan and black linearization tables).

As suggested above, e.g. in discussion of the boundary-locating step, preferred embodiments of our invention here use so-called "customer colors"—which are colors seen in commonplace snapshots of family or friends, and otherwise seen in nature. We prefer these colors to traditional or theoretically based primary and secondary colors.

We have found that system optimization for concealment of light-color banding is much more sensitive when the test-pattern color increments are viewed in their usual context of customer colors. On the other hand, certain colors such as yellow and dark magenta are associated with light-area banding only rarely; therefore in the field we never optimize these colors at all, for interdie-boundary application—instead always simply using a factory-predetermined amount (one percent more than in die bodies).

By using customer colors, and particularly by careful prioritization of the test-pattern sequence, we have made our semiautomatic correction much faster and more robust for the problematic color regions. In the same effort we have minimized use of operator time and machine down time, by pinpointing colors that are seldom implicated in light-color banding.

When the overall procedure is complete, the pipeline best reflects the locations for application of the linearization tables. At this point the effective die boundary locations are fixed, ready for ink-intensity optimizations in the next step.

The system then prints, for final review, a set of prints updated with all the data received from the operator. These prints should be compared with a set of standard threshold examples for acceptable banding—to determine whether the complete procedure should be repeated.

In all of the user inspections described above, preferred embodiments of our invention strongly encourage operators to proceed according to a protocol that we have found to be ideal. Regardless of the stage involved, the operator 10 (FIG. 17) inspects the seven cards 1 through 7, in essence, concurrently—but in pairs of cards 2, 5.

For inspection the operator rotates each card from the landscape orientation in which the cards are printed (FIGS. 14 through 16) into a portrait orientation (FIG. 17) with the ramps RGB that are under active consideration at the top. This orientation places the dark end of each "under consideration" ramp toward the top of the card as viewed.

Complicated multidimensional comparisons can be made, as when the operator already has found that the incremental inking $ab_2$, on one card 2 with its ramp RGB, is more appealing than the incremental inking ab1, ab3 or ab4 on other cards 1, 3, 4 respectively. Possibly the operator will also set aside the next card 5, adding it to the already-rejected cards 1, 3, 4 because its inking $ab_5$, too, is not as attractive as $ab_2$ on the so-far-preferred card 2; it is possible, however, that instead that card 2 may be the next card set aside on the "rejected" group of cards 1, 3, 4.

As the operator proceeds to new cards 6, 7 not yet inspected, one of them may displace both cards 2, 5 currently under consideration—or both new cards 6, 7 may be set aside with the rejected group 1, 3, 4. (In any event the operator can immediately make the best choices part of the image-quality control system, simply by using e.g. a pointing device 29 to enter those choices into a dialog box 28 seen on a computer monitor 27.)

We have found that this concurrent viewing enables the operator to make determinations that are far more sensitive to fine differences in light-area banding than any of the known test-pattern observation procedures mentioned earlier in the "Background" section of this document. We suspect that this enhanced sensitivity results in part because this procedure enables the operator to see at a glance the interaction of:

the ramps RGB (FIG. 17), over their full color ranges, with the superimposed added inking in the boundary strips $ab_2$, $ab_5$.

We further believe that the better sensitivity also arises in part because in cases of difficult comparison the operator using this protocol can apply native intelligence—or can instinctively apply a keen innate intuition, as may be the case—to make rapid multidimensional judgments or choices that would otherwise be impossible or unfeasible.

Thus the operator can trade off improved performance in, for example, one tonal range of the ramps RGB against reduced performance in a different tonal range. For example a particular incremental inking e.g. $ab_2$ may camouflage light-area banding very well when seen in a high-lightness region of a ramp RGB that appears on a particular card 2—but rather poorly when seen in a low-lightness region of the same ramp.

Still more remarkably, concurrent viewing of our highly specialized test-plots permits the operator to, in effect, compare that entire comparison at one inking-increment level $ab_2$ with an analogous entire comparison at a different inking-increment level $ab_5$. Thus the testing may be particularly powerful when an operator thinks something like, "I like this light inking $ab_2$ a lot, down near the light bottom of the ramp on card 2—but not as much as I like this darker inking $ab_5$ up near the dark top of the ramp on card 5."

Such theoretical interpretation of the enhanced results, however, is not a part of our invention as defined in most of the appended claims. Thus people skilled in this field will understand that neither the usefulness nor the validity of our invention depends on the correctness of the theoretical interpretation.

As mentioned earlier, our invention cannot force light-area banding to disappear. The invention can only reduce and improve the banding.

Figure 18:
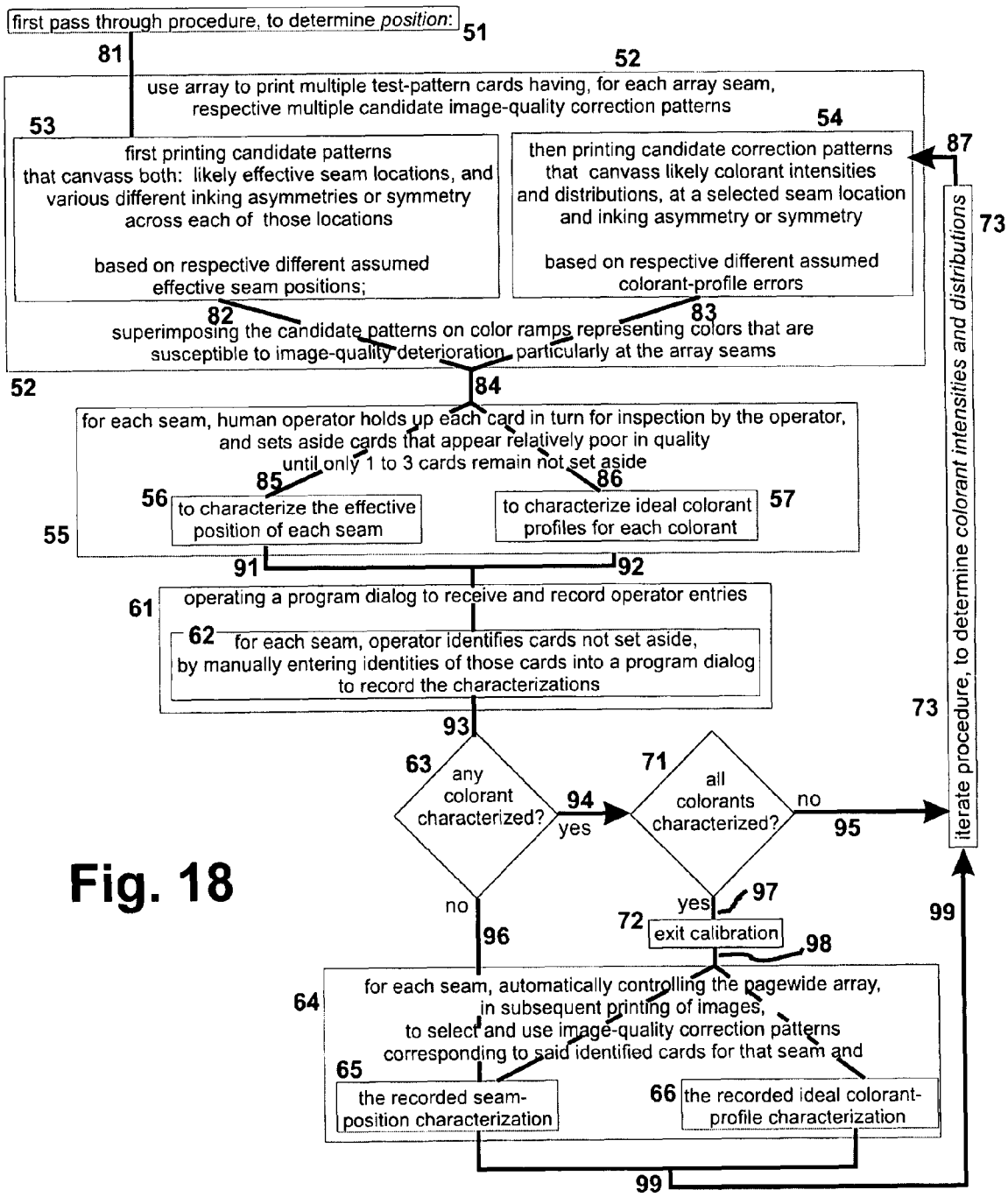
FIG. 18 is a generalized flow chart, partly simplified, for a preferred embodiment of the programmed processor(s) of the present invention.

The procedures followed in the preferred practice of our invention have been described above. Some additional detail may be helpful:

The system begins 51 (FIG. 18) a first pass through the overall procedure 52-64, particularly passing through certain procedural submodules 53, 85, 62 to decisional unit 63. At that point if no colorant has yet been characterized, the first pass continues via block 65 (use of a recorded boundary-location characterization) and through an iteration path 99, 73, 87 to restart the overall procedure—but now passing through different submodules 54, 57, 62 to again reach the decisional unit 63.

This time, however, a colorant has been characterized, so the procedure branches 94 to ask 71 whether all colorants have been characterized. The first traversal of that block 71 leads 95 again to the iteration path 99, 73, 87 and reentry to the second group of submodules 54, 57, 62. Upon once more reaching the decision blocks 63, 71, since all colorants are now characterized, the system exists 72 calibration.

The recorded data 65, 66, however, are now available for use 64 in controlling the system for printing of end-user images. With the foregoing orientation, it is believed that other details of FIG. 18 will be found self explanatory.

The above disclosure is intended as merely exemplary, and not to limit the scope of the invention—which is to be determined by reference to the appended claims.

What is claimed is:

1. A method for improving image quality printed by a pagewide printing array that is made of several inkjet dice positioned generally end-to-end at array seams; said method comprising the steps of:

using the pagewide array to print multiple test-pattern cards having, for each seam, respective multiple candidate image-quality correction patterns;

for each seam, a human operator's holding up each card in turn for inspection by the operator, and setting aside cards that appear relatively poor in quality until only one to three cards remain not set aside;

for each seam, identifying the cards not set aside, by the operator's manually entering identities of those cards into a program dialog; and for each seam, automatically controlling the pagewide array, in subsequent printing of images, to select and use image-quality correction patterns corresponding to said identified cards for that seam.

2. The method of claim 1, wherein:

the using, holding up and identifying steps in combination characterize the effective position of each seam; and the controlling step comprises controlling the array in accordance with the characterized position of each seam.

3. The method of claim 2, wherein:

the using step comprises printing, on each card, candidate correction patterns based upon respective different assumed effective seam positions.

4. The method of claim 2, wherein:

the using, holding and identifying steps in combination also characterize ideal colorant profiles for each of at least one colorant; and the controlling step comprises controlling the array in accordance with the characterized ideal colorant profile.

5. The method of claim 4, wherein:

the using step comprises printing, on each card, candidate correction patterns based upon respective different assumed colorant-profile errors.

6. The method of claim 5, wherein the using step further comprises the step of:

superimposing the candidate correction patterns on a color ramp representative of colors that are susceptible to image-quality deterioration particularly at the array seams.

7. The method of claim 1, further comprising the step of:

operating the program dialog to receive the operator's manually entered identities.

8. The method of claim 1, wherein the using comprises:

first, printing candidate correction patterns that canvass, to enable selection from among, both:

likely effective seam locations, and various different inking asymmetries or symmetry across each of those effective seam locations; and then, printing candidate correction patterns that canvass likely colorant intensities and distributions, at a selected seam location and inking asymmetry or symmetry.

9. In combination, (1) a control system for a pagewide array made of inkjet dice positioned generally end-to-end at array seams; and (2) a set of test-pattern cards for improving image quality printed by the array; and wherein:

for each seam, said card set comprises, printed on multiple cards respectively, multiple candidate image-quality correction patterns;

the control system comprises means for:

printing the card set expressly for interactive, use by a human operator in holding up each card for inspection by the operator, and in setting aside cards that appear relatively poor in quality until only one to three cards remain not set aside, and cooperatively interacting with the human operator in a program dialog, to receive the operator's manually entered identities of cards not set aside, and for each seam, automatically controlling the array, in subsequent printing of images, to select and use image-quality correction patterns corresponding to said identified cards.

10. The combination of claim 9, wherein:

each correction pattern is superimposed on a color ramp representative of colors that are susceptible to image-quality deterioration particularly at the array seams.

11. The combination of claim 10, wherein:

some correction patterns are used to determine effective positions of array seams.

12. The combination of claim 11, wherein said representative color ramp for use with said position-determining patterns comprises, with reference to an intensity scale from zero to 255:

along a light-blue edge, a combination of red, green and blue, substantially in intensities 135, 170 and 185 respectively;

along a dark-blue edge, a combination of red, green and blue, substantially in intensities 86, 123 and 164 respectively; and a gradation of colors between the two edges.

13. The combination of claim 10, wherein:

some correction patterns are used to determine best color details of image-quality correction patterns.

14. The combination of claim 13, wherein said representative color ramp for use with said color-detail-determining correction patterns comprises, with reference to an intensity scale from zero to 255:

along a light-magenta edge, a combination of red, green and blue, substantially in intensities 255, 219 and 255 respectively;

along a darker-magenta edge, a combination of red, green and blue, substantially in intensities 255, 101 and 255 respectively; and a gradation of colors between the two edges.

15. The combination of claim 13, wherein said representative color ramp for use with said color-detail-determining correction patterns comprises, with reference to an intensity scale from zero to 255:

along a light-gray edge, a combination of red, green and blue, substantially in intensities 200, 200 and 200 respectively;

along a darker-gray edge, a combination of red, green and blue, substantially in intensities 100, 100 and 100 respectively; and a gradation of colors between the two edges.

16. The combination of claim 13, wherein said representative color ramp for use with said color-detail-determining correction patterns comprises, with reference to an intensity scale from zero to 255:

along a gray edge, a combination of red, green and blue, substantially in intensities 110, 110 and 110 respectively;

along a substantially black edge a combination of the same three colors, each substantially at zero intensity; and a gradation of colors between the two edges.

17. The combination of claim 9, in further combination with:

said pagewide array;

the control system; and a printer incorporating the array and control system.

18. The combination of claim 17, wherein the control system further comprises means for, at each seam and based upon said cooperatively-interacting:

generating a series of linearization curves for multiple subboundaries within said seam;

said linearization curves being smoothly interpolated between measured linearization curves for two adjacent dice; and applying said linearization curves to determine colorant levels at said subboundaries.

* * * * *